US010605518B2

(12) United States Patent
Park

(10) Patent No.: US 10,605,518 B2
(45) **Date of Patent: *Mar. 31, 2020**

(54) REFRIGERATOR AND DOOR OPENING AND CLOSING APPARATUS FOR REFRIGERATOR

(71) Applicant: LG Electronics Inc., Seoul (KR)

(72) Inventor: Kihyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,914

(22) Filed: Jul. 10, 2019

(65) Prior Publication Data

US 2019/0331400 A1 Oct. 31, 2019

Related U.S. Application Data

(63) Continuation of application No. 15/873,414, filed on Jan. 17, 2018.

(30) Foreign Application Priority Data

Jan. 19, 2017 (KR) ..... 10-2017-0009276

(51) Int. Cl.

| | |
|---|---|
| ***F25D 23/02*** | (2006.01) |
| ***F25D 23/04*** | (2006.01) |
| ***E05B 1/00*** | (2006.01) |
| ***E05B 65/00*** | (2006.01) |

(Continued)

(52) U.S. Cl.

CPC ..... *F25D 23/04* (2013.01); *E05B 1/0038* (2013.01); *E05B 65/0046* (2013.01); *E05C 3/24* (2013.01); *E05C 7/02* (2013.01); *F25D 23/025* (2013.01); *F25D 23/028* (2013.01); *F25D 2323/023* (2013.01); *F25D 2323/024* (2013.01)

(58) Field of Classification Search

CPC ..... F25D 23/025; F25D 23/02; F25D 23/028; E05B 65/0042

USPC ..... 312/405

See application file for complete search history.

(56) References Cited

U.S. PATENT DOCUMENTS

| | | | |
|---|---|---|---|
| 2,243,772 | A | 5/1941 | Peltier |
| 8,752,918 | B2 | 6/2014 | Kang |
| 2013/0026900 | A1 | 1/2013 | Oh et al. |

(Continued)

FOREIGN PATENT DOCUMENTS

| | | |
|---|---|---|
| KR | 1020130015989 | 2/2013 |
| KR | 2013053318 | 5/2013 |

(Continued)

*Primary Examiner* — Matthew W Ing

(74) *Attorney, Agent, or Firm* — Fish & Richardson P.C.

(57) ABSTRACT

A refrigerator includes a cabinet, a main-door, the main-door, a sub-door, a restraint device that protrudes from a rear surface of the sub-door, a latch device located at the main-door and configured to selectively restrict movement of the restraint device, and an operation device located at the sub-door and configured to release the restraint device from the latch device. The latch device includes a latch configured to restrict movement of the restraint device from the latch based on rotation of the latch, a stopper configured to engage a side of the latch and limit movement of the latch, a pusher configured to push the stopper to cause the stopper to rotate, and an elastic member connected to the latch and to the stopper. The latch is configured to, based on rotation of the stopper, rotate and release restraint between the latch and the stopper.

19 Claims, 15 Drawing Sheets

(51) Int. Cl.
*E05C 3/24* (2006.01)
*E05C 7/02* (2006.01)

(56) References Cited

U.S. PATENT DOCUMENTS

| | | | |
|---|---|---|---|
| 2015/0176886 | A1 | 6/2015 | Lee et al. |
| 2015/0260443 | A1 | 9/2015 | Lee et al. |
| 2015/0308158 | A1 | 10/2015 | Jeon |
| 2016/0138855 | A1 | 5/2016 | Choo et al. |

FOREIGN PATENT DOCUMENTS

| | | |
|---|---|---|
| KR | 2015074285 | 7/2015 |
| WO | WO2011081279 | 7/2011 |

REFRIGERATOR AND DOOR OPENING AND CLOSING APPARATUS FOR REFRIGERATOR

CROSS-REFERENCE TO RELATED APPLICATION

This application is a continuation of U.S. application Ser. No. 15/873,414, filed on Jan. 17, 2018, which claims priority under 35 U.S.C. § 119 to Korean Patent Application No. 10-2017-0009276, filed in Korea on Jan. 19, 2017. The disclosures of the prior applications are incorporated by reference in their entirety.

TECHNICAL FIELD

The present invention relates to a refrigerator and a door opening and closing apparatus for a refrigerator.

BACKGROUND

Generally, a refrigerator is a household appliance that allows low-temperature storage of food in an internal storage space that is shielded by a door. To this end, the refrigerator is configured to store the stored food in an optimal state by cooling the inside of the storage space by using cool air generated through heat exchange with the refrigerant circulating in the refrigeration cycle.

Recently, refrigerators have become increasingly large and multifunctional according to changes in dietary life and upgrading of a product and refrigerators having various structures and convenience devices in consideration of user convenience, energy efficiency, or the like are being released.

Typically, there is a refrigerator which has a separate storage space formed in a door of the refrigerator and a home bar door that can open and close the separate storage space so that food can be stored therein.

In addition, Korean Patent Laid-Open Publication No. 10-2013-0015989 discloses a refrigerator having a button for opening a latch capable of opening and closing a door of a latch structure on a door handle of the refrigerator, thereby providing ease of use. In a state where the door is closed, the stopper is rotated by the operation of the button of the user in a state where the latch member and the stopper are engaged and restrained so that restraint with the latch member is released and the door can be opened.

However, in such a related art, the stopper and the latch member, which are rotated to open the door, are rotated in directions opposite to each other when the door is opened. Particularly, in a case where the button is pushed while the door handle pulls due to the operating characteristic of the door that door is opened by pushing the button while the door handle pulls since the button is provided on the door handle, the latch member is rotated in a direction opposite to a rotation direction of the stopper by the pulling force of the door and thus the latch member and the stopper can be further restrained to each other. Accordingly, there is a problem that a button pushing force increases and thus it is inconvenient for the user to operate the refrigerator. In addition, there is a problem that a clicking noise is generated by strong rotation when the restraint of stopper and the latch member is released.

SUMMARY

An object of the present invention is to provide a refrigerator and a door opening and closing apparatus for a refrigerator that has improved operability of a door opening and closing apparatus for opening and closing a door.

An object of the present invention is to provide a refrigerator and a door opening and closing apparatus for a refrigerator that prevents noise from being generated by a door opening and closing apparatus when the door is opened.

An object of the present invention is to provide a refrigerator and a door opening and closing apparatus for a refrigerator which can open the door by operating the door opening and closing apparatus with less force when the door is opened.

According to an embodiment of the present invention, there is provided a refrigerator including: a cabinet in which a storage space is formed; a main-door that opens and closes the storage space and has a door storage space; a sub-door that opens and closes the door storage space; a restraint device that protrudes from a rear surface of the sub-door; a latch device that is provided on the main-door, accommodates the restraint device, and selectively restrains; and an operation device that is provided on the sub-door and releases restraint of the latching device and the restraint device by a pushing operation by a user, in which the latch device includes a latch member which is mounted rotatably and is selectively restrained with the restraint device by rotation, a stopper member which is rotatably coupled below the rotation shaft of the latch member, extends to an upper side of the latch member, and is selectively engaged and restrained with one side of the latch member by rotation, a push member which is provided on an upper side of the latch member and is moved when the operation device is operated, pushes and rotates the stopper member, and an elastic member which is connected with the latch member and the stopper member and provides elasticity so that the latch member and the stopper member are in contact with each other, in which when the stopper member is rotated in one direction by the push member, the latch member is rotated in the same direction as a rotation direction of the stopper member and thus restraint between the latch member and the stopper member is released.

The operation device may include a button exposed to a handle mounted on a front surface of the sub-door.

A handle connection portion which connects a space which is spaced apart between the handle and the front surface of the door, in which the operation device may further include a handle case which is fixed to an inside of the handle and accommodates the button, and a push rod which extends from the button, passes through the handle connection portion, and operates the push member.

The restraint device may include a transfer unit which is moved by operation of the button and selectively presses the push member; and a hook member which protrudes rearward from a rear surface of the sub-door and in which a hook opening is formed into which a portion of the latch member is inserted, engaged, and restrained when the latch member is rotated.

A first elastic member fixing portion protrudes from the latch member above the rotation shaft of the latch member, a second elastic member fixing portion protrudes from one side of the stopper member above the first elastic member fixing portion, and it is possible to connect the first elastic member fixing portion and the second elastic member fixing portion with each other.

The elastic member may be configured by a tension spring, and both ends of the elastic member may be fixed to the first elastic member fixing portion and the second elastic member fixing portion, respectively.

A stop protrusion protruding toward the latch member is formed on one side of the stopper member, an engagement portion protruding from the one side of the latch member toward the stopper member is formed and the stop protrusion and the engagement portion may be engaged with each other and restrained in a position where an end portion of the restraint device is restrained in the latch member.

The outside surface of the latch member may have a curved surface portion formed to be rounded to the engagement portion and the stop protrusion may be moved in a state of being in contact with the curved surface portion when the latch member is rotated.

The stopper member is provided with a recessed portion which receives one side of the latch member and the stop protrusion may be formed in the recessed portion.

The recessed portion is formed to be longer than the vertical length of the latch member and the latch member may be rotated between the upper end and the lower end of the recessed portion.

The first elastic member fixing portion may be located higher than the stop protrusion and the second elastic member fixing portion may be located higher than the recessed portion.

A contact portion which forms a surface that is in contact with a rear end of the push member may be formed above the recessed portion.

The second elastic member fixing portion may be formed at a rear end of the stopper member and the contact portion may be formed at a front end of the stopper member.

The stopper member is formed in a plate-like shape, the recessed portion is formed at a side end of the stopper member, and contact portions in which the second elastic member fixing portion and the push member are in contact with each other may be bent in directions opposite to each other on the upper end of the stopper member.

All the rotation shaft of the stopper member, the rotation shaft of the latch member, and the stop protrusion, and the engagement portion can be positioned in the area between both ends of the elastic member.

The stop protrusion and the engagement portion may be positioned between the rotation shaft of the stopper member and the rotation shaft of the latch member.

The front end of the push member is exposed through the front surface of the main-door so as to be capable of being pushed when the operation device is operated and a rear end of the push member may be selectively in contact with the stopper member.

A push guide which guides the forward and backward movement of the push member may be formed above the latch member.

According to an embodiment of the present invention, there is provided a door opening and closing apparatus for a refrigerator including: a restraint device which protrudes to a door rear surface; a latch device that is provided on a cabinet in which a storage space which is opened and closed by the door is formed, accommodates the restraint device and selectively restrains; and an operation device that is provided on the door and releases restraint between the latch device and the restraint device by a pushing operation by a user, in which the latch device includes a latch member which is mounted rotatably and is selectively restrained with the restraint device by rotation, a stopper member which is rotatably coupled below the rotation shaft of the latch member, extends to an upper side of the latch member, and is selectively engaged and restrained with one side of the latch member by rotation, a push member which is provided on an upper side of the latch member and is moved when the operation device is operated, pushes and rotates the stopper member, and an elastic member which is connected with the latch member and the stopper member and provides elasticity so that the latch member and the stopper member are in contact with each other, in which when the stopper member is rotated in one direction by the push member, the latch member is rotated in the same direction as the rotation direction of the stopper member and thus restraint between the latch member and the stopper member is released.

A barrier for partitioning the storage space may be formed in the cabinet, and the latch device may be provided on a front surface of the barrier.

The following effects can be expected from the refrigerator and the door opening and closing apparatus of the refrigerator according to the embodiment of the present invention.

The door opening and closing apparatus according to the embodiment of the present invention has an advantage that a noise is not generated when restraint between the stopper member and the latch member is released by rotation direction of the stopper member and the latch member which are rotated by pushing operation of the button being identical to each other when the button of the operation device is pressed and the door is opened.

In addition, when the button is operated, since the stopper member and the latch member are configured to rotate in the same direction, much power is not consumed to release the engagement and restraint of the stopper member and the latch member and thus there is an advantage that the operation becomes easier and the operation convenience is improved.

Therefore, the operability of the door can be improved and the convenience of the user can be improved.

DESCRIPTION OF EMBODIMENTS

Hereinafter, specific embodiments of the present invention will be described in detail with reference to the drawings. However, it should be understood that the present invention is not limited to the embodiment in which the concept of the present invention is presented and that other embodiments may be easily devised which include another degenerating invention by way of addition, alteration, deletion, or the like of other constituent elements or within the spirit of the present invention.

Figure 1:
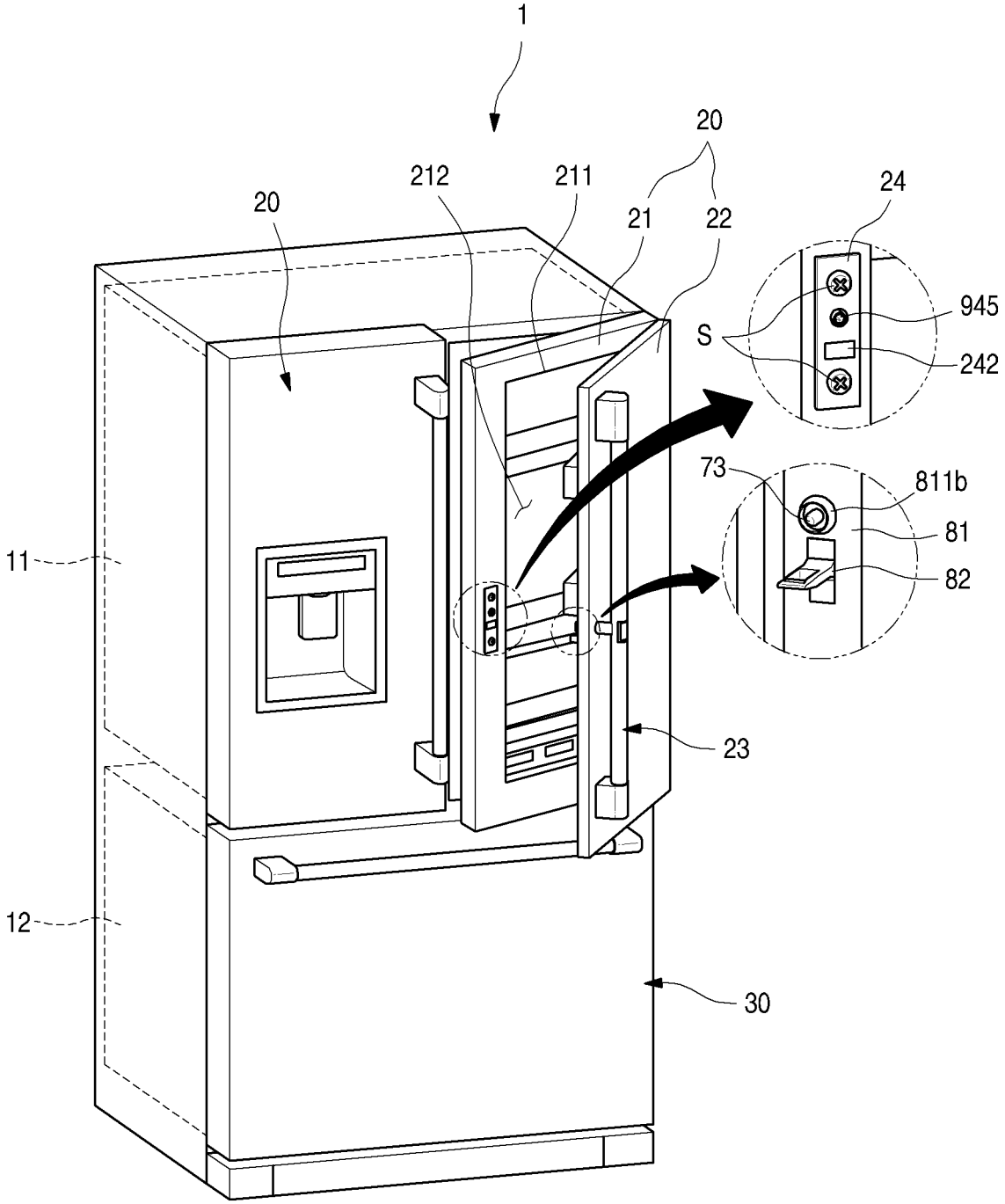
FIG. 1 is a perspective view illustrating a refrigerator according to an embodiment of the present invention.
Figure 2:
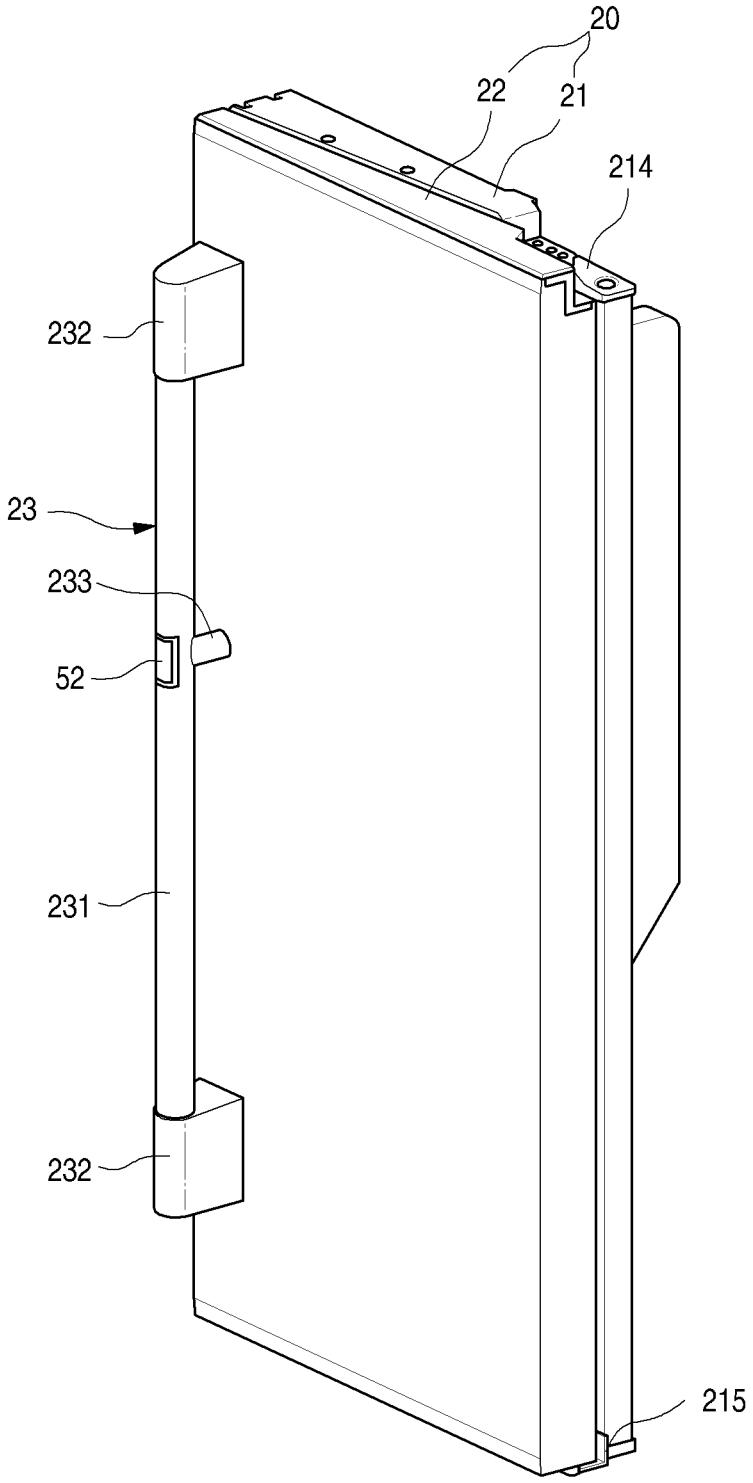
FIG. 2 is a perspective view illustrating a door according to an embodiment of the present invention.
Figure 3:
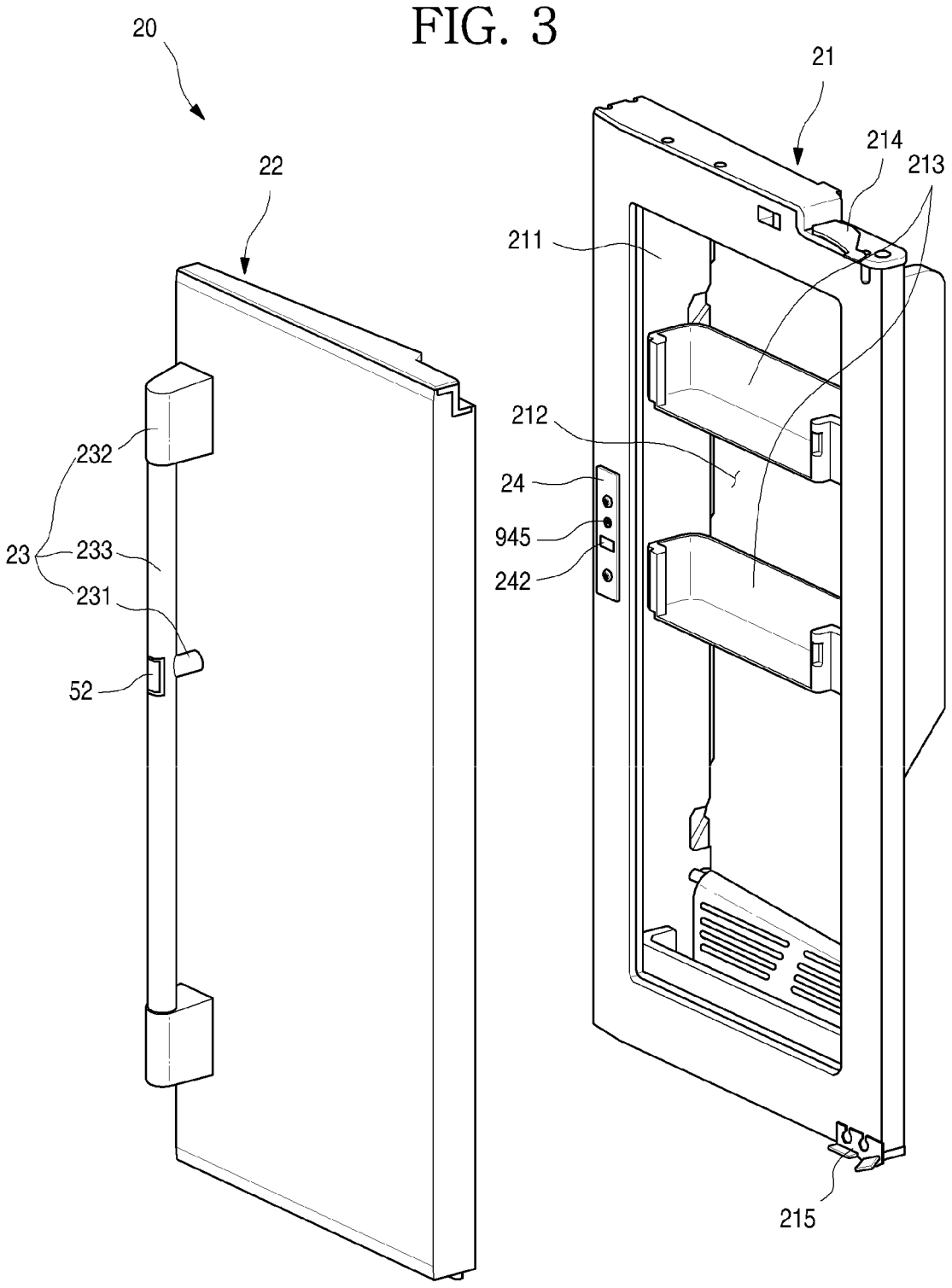
FIG. 3 is an exploded perspective view illustrating a main-door and a sub-door constituting the door.

FIG. 1 is a perspective view illustrating a refrigerator according to an embodiment of the present invention. FIG. 2 is a perspective view illustrating a door according to an embodiment of the present invention. FIG. 3 is an exploded perspective view illustrating a main-door and a sub-door constituting the door.

As illustrated in the drawings, an outer appearance of the refrigerator 1 according to the embodiment of the present invention may be shaped by a cabinet 10 forming a storage space and a door opening and closing the storage space.

The inside of the cabinet 10 is divided into upper and lower portions to form a freezing chamber 12 and a refrigerating chamber 11, respectively. The refrigerating chamber 11 on the upper portion of the cabinet 10 may be configured to be opened and closed by a pair of refrigerating chamber doors 20. The refrigerating chamber door 20 is rotatably mounted on both left and right sides of the cabinet 10 and a pair of refrigerating chamber doors 20 disposed on both left and right sides of the cabinet 10 can be independently opened and closed according to the user's selection. The freezing chamber door 30 may be configured to go in and out in the form of a drawer in the cabinet 10 and may be configured to open and close the freezing chamber 12 by sliding in and out.

The disposition of the refrigerating chamber 11 and the freezing chamber 12 and the disposition and structure of the refrigerating chamber door 20 and the freezing chamber door 30 may be variously changed according to the type of the refrigerator 1, and the present invention is not limited to the structure of the refrigerator 1 but may be applied to all types of refrigerators 1 that are opened and closed by rotation.

The refrigerating chamber door 20 may include a main-door 21 and a sub-door 22. The main-door 21 is rotatably coupled to the cabinet 10 to open and close the refrigerating chamber 11. The sub-door 22 is rotatably coupled to the main-door 21 to open and close the door storage space 212 formed in the main-door 21.

To this end, an opening portion 211 is formed in the main-door 21 and a plurality of baskets 213 are provided inside the opening portion 211 to form the door storage space 212. The opening portion 211 may be formed over most of the area except the periphery of the main-door 21. The opening portion 211 may be selectively opened and closed by rotation of the sub-door 22, access to the door storage space 212 becomes possible.

The sub-door 22 forms an outer appearance of the front surface of the refrigerating chamber door 20 and may be configured to shield the entire front surface of the main-door 21. The upper and lower ends of the sub-door 22 may be axially coupled to an upper hinge 214 and a lower hinge 215 respectively provided in the main-door 21 and the upper hinge 214 and the lower hinge 215 may be a rotation shaft of the sub-door 22.

A handle 23 that can be held by a user for opening and closing the main-door 21 and the sub-door 22 is provided at one side end of the front surface of the sub-door 22 which is remote from the rotation shaft of the sub-door 22. Therefore, it is possible to facilitate a rotation operation of the sub-door 22 by holding the handle 23.

The handle 23 may be spaced from the front surface of the sub-door 22 so that a user can easily grasp the handle 23 in order to rotate the sub-door 22. The handle 23 is vertically extended so that the handle 23 can be held by a user and can include a handle bar 231, a pair of handle mounting portions 232 which is coupled to the sub-door 22 at both ends of the handle bar 231 and is fixed in a state where the handle bar 231 is spaced apart from the front surface of the sub-door 22, and a handle connection portion 233 which connects a space between the pair of handle mounting portion 232 and a space between the handle 23 and the sub-door 22 with each other.

The button 52 constituting the operation device 50 may be exposed on the front surface of the handle 23. The button 52 is to operate by the user to open the sub-door 22 and is configured to be depressed by the user. The position of the button 52 has a height at which a user approximately having an average height can easily press the button and may be formed at a position corresponding to the handle connection portion 233. The first push rod 53 connected to the button 52 may extend to protrude from the rear surface of the sub-door 22 through the handle connection portion 233.

Of course, the structure of the handle 23 is formed such that the handle bar 231 is vertically rounded without the handle mounting portion 232, and both ends of the handle bar 231 are directly fixed to and mounted on the front surface of the sub-door 22.

On the other hand, the main-door 21 corresponding to the operation device 50 may be provided with a latch device 90. The latch device 90 may be provided at a position corresponding to the operation device 50 provided in the sub-door 22. Accordingly, the operation of the latch device 90 becomes possible according to the operation of the operation device 50 and the sub-door 22 can be selectively restrained and opened.

Figure 4:
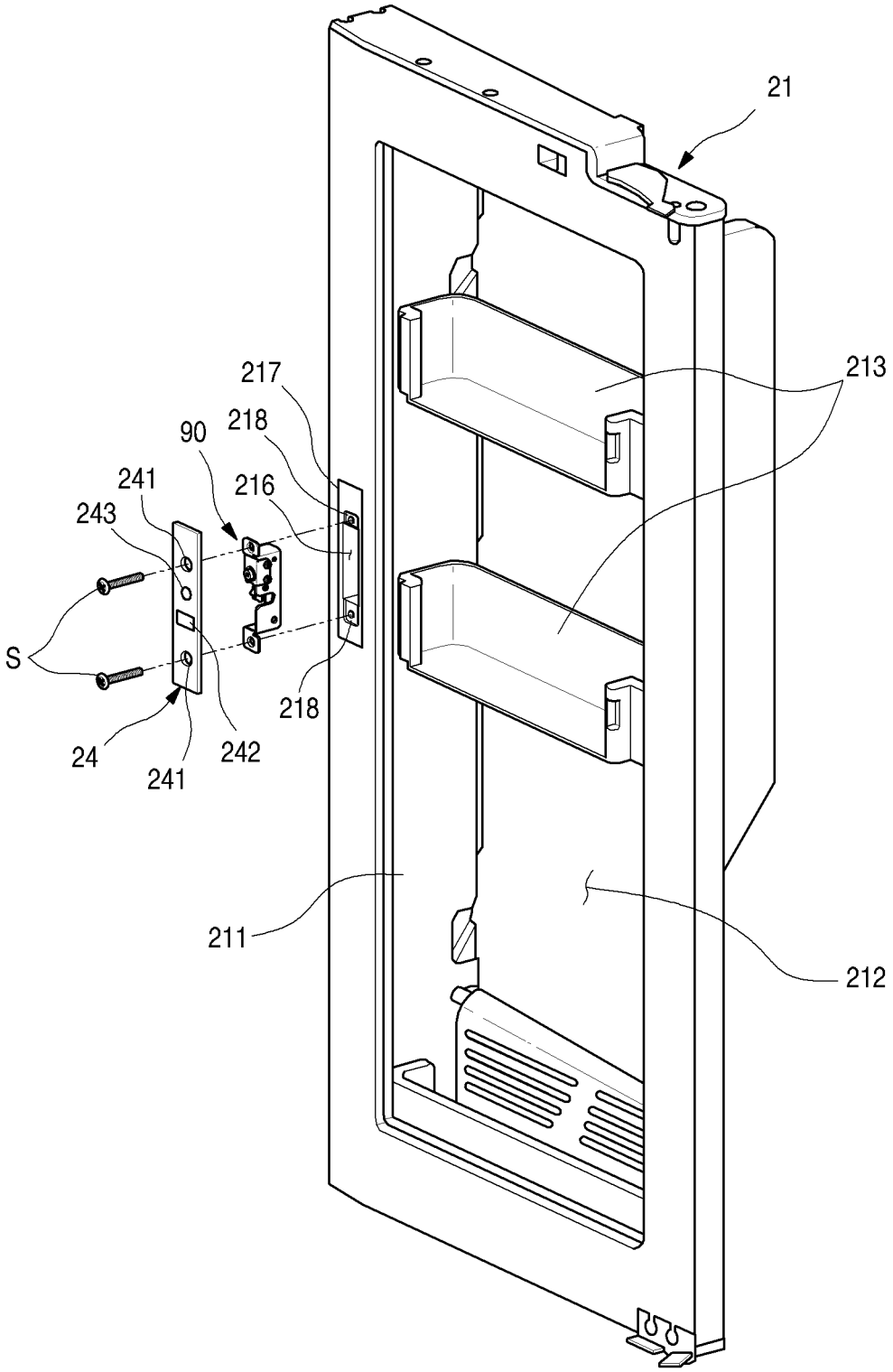
FIG. 4 is an exploded perspective view illustrating a coupling structure of the main-door and the latch device.

FIG. 4 is an exploded perspective view illustrating a coupling structure of the main-door and the latch device.

As illustrated in the drawing, a latch device accommodation portion 216 in which the latch device 90 is accommodated may be recessed in the front surface of the main-door 21. The upper and lower ends of the latch device accommodation portion 216 may be formed with a latch device seating portion 218 on which the upper and lower ends of the latch device 90 can be seated.

A plate stepped portion 217 may be formed around the latch device accommodation portion 216. The opening of the plate stepped portion 217 may be formed to have a larger size than the opening of the latch device accommodation portion 216. Then, the latch device 90 can be shielded by the cover plate 24 mounted on the plate stepped portion 217.

The cover plate 24 is for shielding the latch device 90 and has a size corresponding to the opening of the plate stepped portion 217. The cover plate 24 may be flush with the front surface of the main-door 21 in a state where the cover plate 24 is mounted on the plate stepped portion 217.

The cover plate 24 may be formed with a fastening hole 241 to which the screw S is fastened. The screw S passing through and being fastened to the fastening hole 241 passes through the upper end and the lower end of the latch device 90 and can be fastened to the latch device seating portion 218. Therefore, the cover plate 24 and the latch device 90 can be kept a state of being fixed to the main-door 21.

A hook slot 242 through which the hook member 82 for selectively restraining the sub-door 22 goes in and out may be formed between the fastening holes 241. The hook slot 242 may be formed at a corresponding position such that the hook member 82 can be selectively restrained with the latch member 92 to be described below.

A plate hole 243 may be formed between the hook hole 241 and the hook slot 242 adjacent to the hook hole. The plate hole 243 is formed to expose the push member 945 of the latch device 90 to be described below and is formed at a corresponding position so as to force the operation of the stopper member 93 to be described below.

Figure 5:
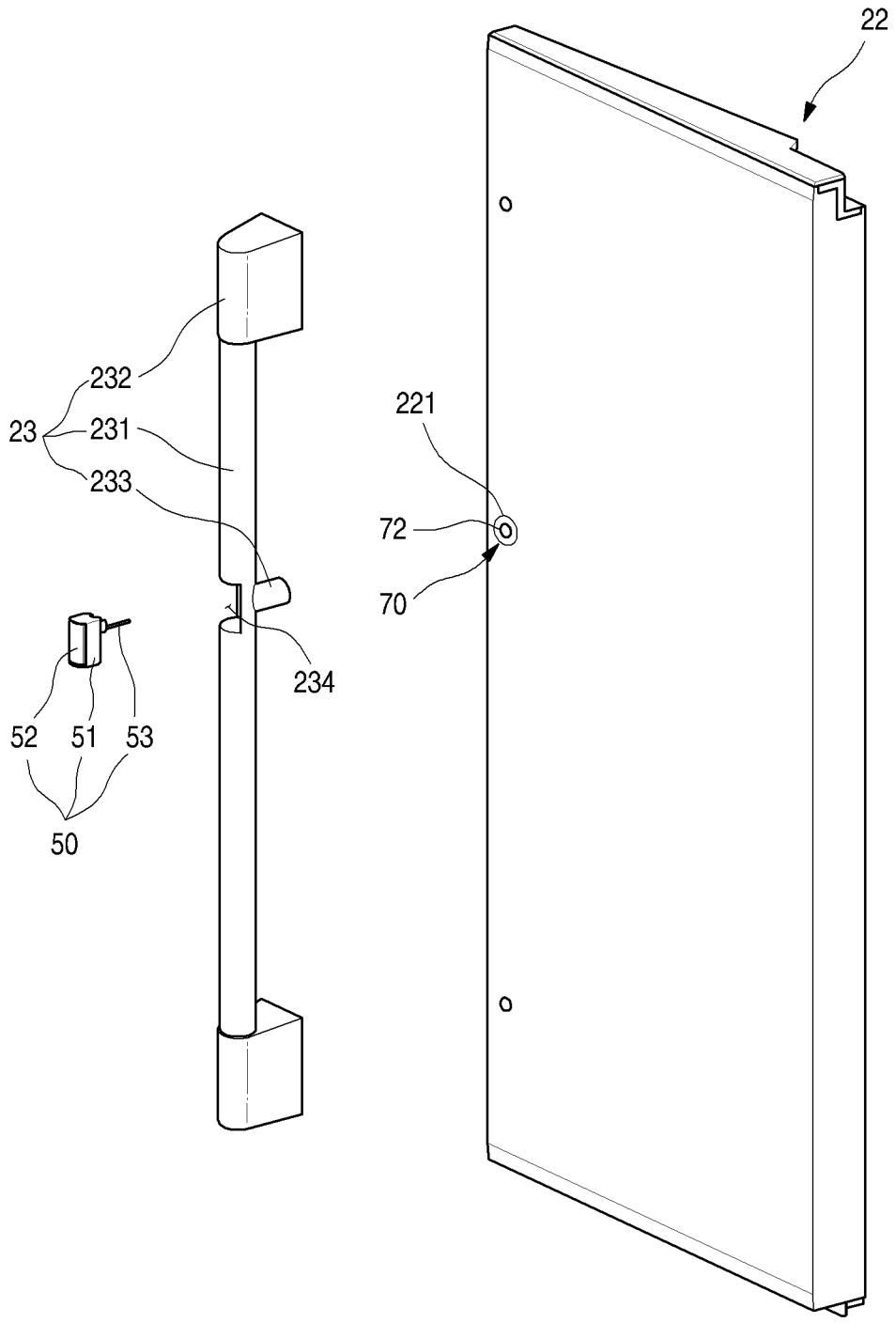
FIG. 5 is an exploded perspective view illustrating a coupling structure of the handle and the operation device of the sub-door.

FIG. 5 is an exploded perspective view illustrating a coupling structure of the handle and the operation device of the sub-door.

As illustrated in the drawing, the handle 23 can be fixed to and mounted on the front surface of the sub-door 22. In addition, the operation device mounting portion 234 may be recessed in the handle 23. The operation device mounting portion 234 may be formed at a position where the operation device mounting portion 234 can communicate with the handle connection portion 233. At this time, the height of the operation device mounting portion 234 is formed at a position corresponding to the center of the handle 23 or at the shoulder height of the user to facilitate the user's operation.

The operation device 50 can be inserted into the operation device mounting portion 234. The operation device 50 may include an operation device case 51 which is formed to have a size corresponding to the opening of the operation device mounting portion 234, a button 52 which is provided inside the operation device case 51 to be capable of pressing, and a first push rod 53 which is connected to the button 52 and moved in the front and rear directions according to a pressing operation of the button 52.

A spring (not illustrated) is provided inside the operation device case 51 to elastically support the button 52. In a state where the button 52 is not operated, it is possible to maintain a state where the button 51 protrudes to the same flat surface as an outside surface of the handle 23. The front surface of the button 52 may have the same curved surface as that of the outside surface of the handle 23 so that the operation device 50 and the handle 23 have a sense of unity.

The first push rod 53 may extend rearward from the button 52 and may be configured to be accommodated on the inside of the handle connection portion 233. In addition, when the button 52 is pressed, the button can further protrude rearward of the handle connection portion 233. At this time, the length of the first push rod 53 is configured so that the rear end of the first push rod 53 passes through the handle connection portion 233 when the button 52 is pressed and can operate a transfer unit 70 on the front surface of the sub-door 22. The transfer unit 70 is provided on the front surface of the sub-door 22 corresponding to the handle connection portion 233 and is configured so as to be operated by the rear end of the first push rod 53 which protrudes when the button 52 is pressed.

The front surface of the transfer unit 70 may be positioned on the same plane as the front surface of the sub-door 22 and may be configured to be in contact with the handle connection portion 233. The transfer unit 70 may be provided with a contact member 72 which is in contact with the first push rod 53. The contact member 72 may be configured to partially exposed through the front hole 221 on the front surface of the sub-door 22 and be pushed by the rear end of the first push rod 53 passing through the front hole 221. The front hole 221 and the contact member 72 are shielded by the handle connection portion 233 so that the front hole 221, as well as the transfer unit 70, are not exposed to the outside after the handle 23 is mounted.

Figure 6:
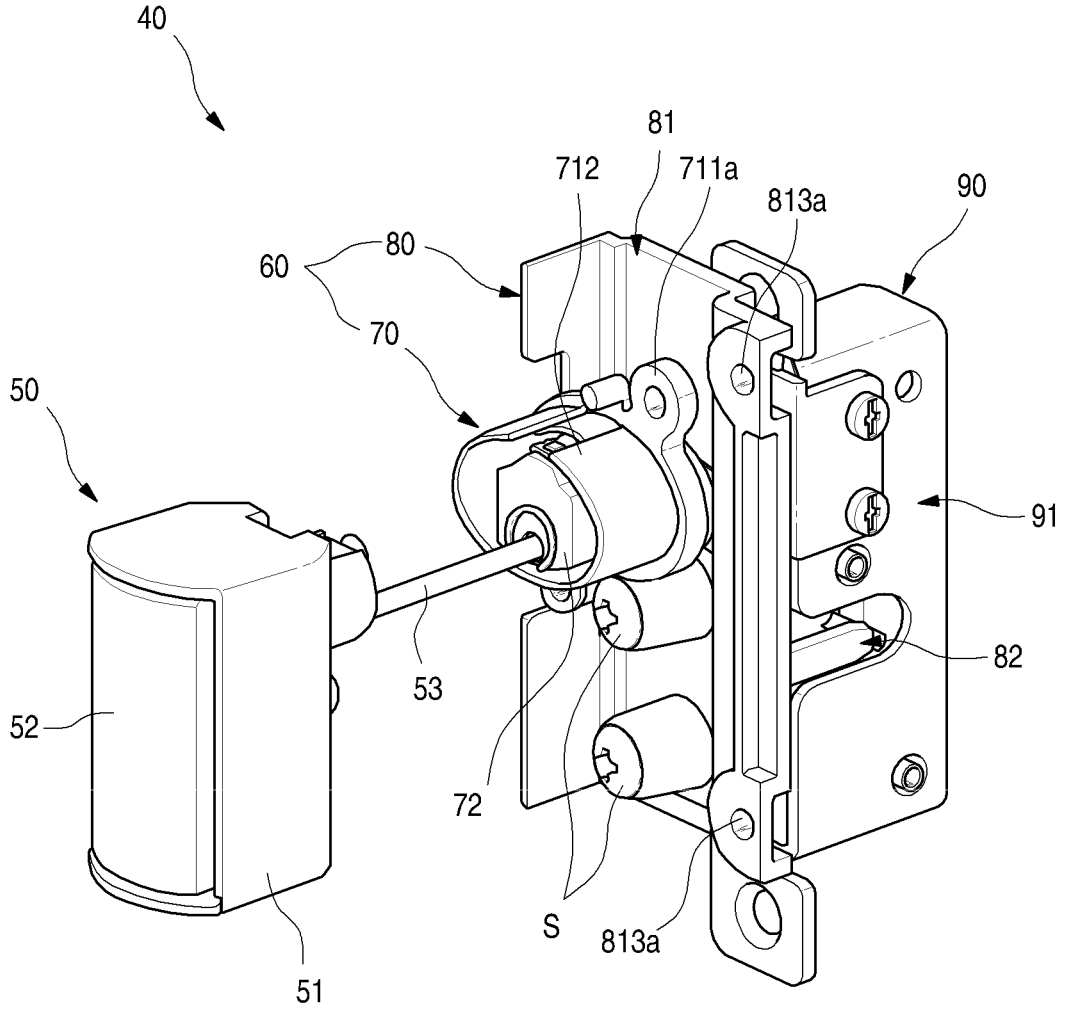
FIG. 6 is a perspective view illustrating a door opening and closing apparatus according to an embodiment of the present invention.
Figure 7:
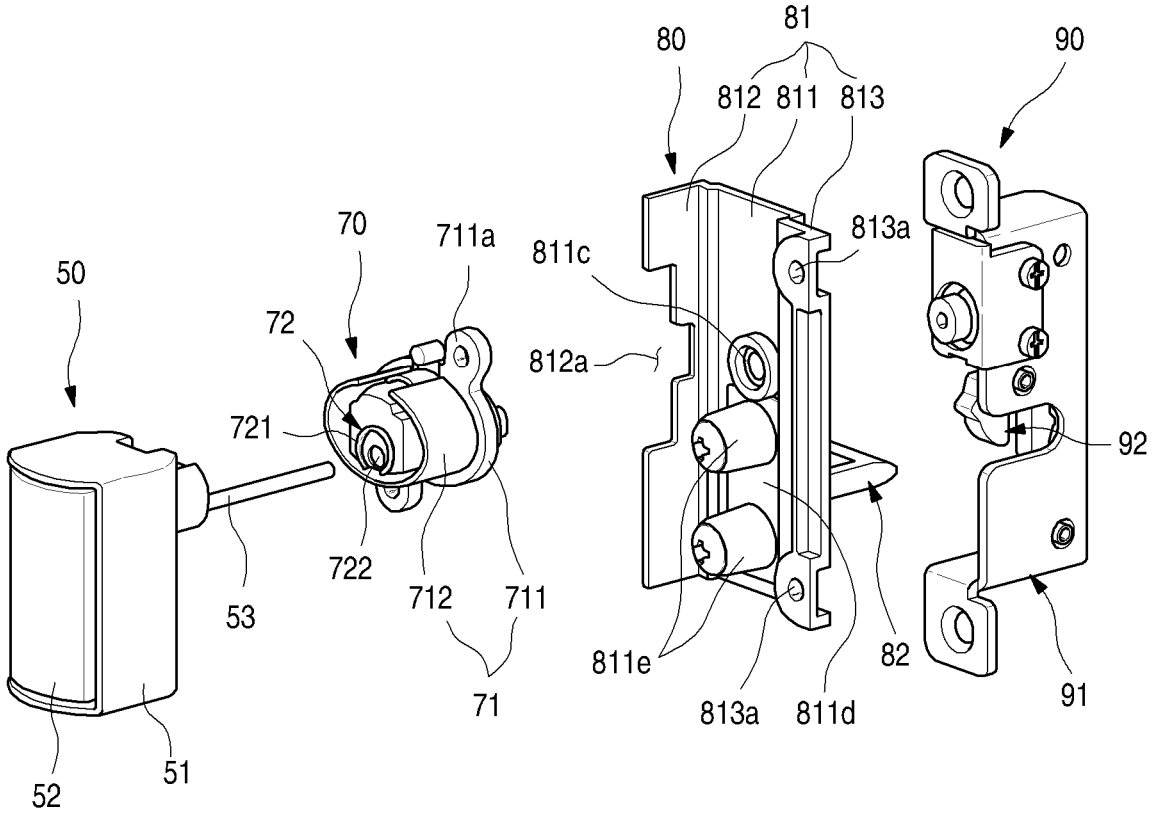
FIG. 7 is an exploded perspective view illustrating the door opening and closing apparatus viewed from one direction.
Figure 8:
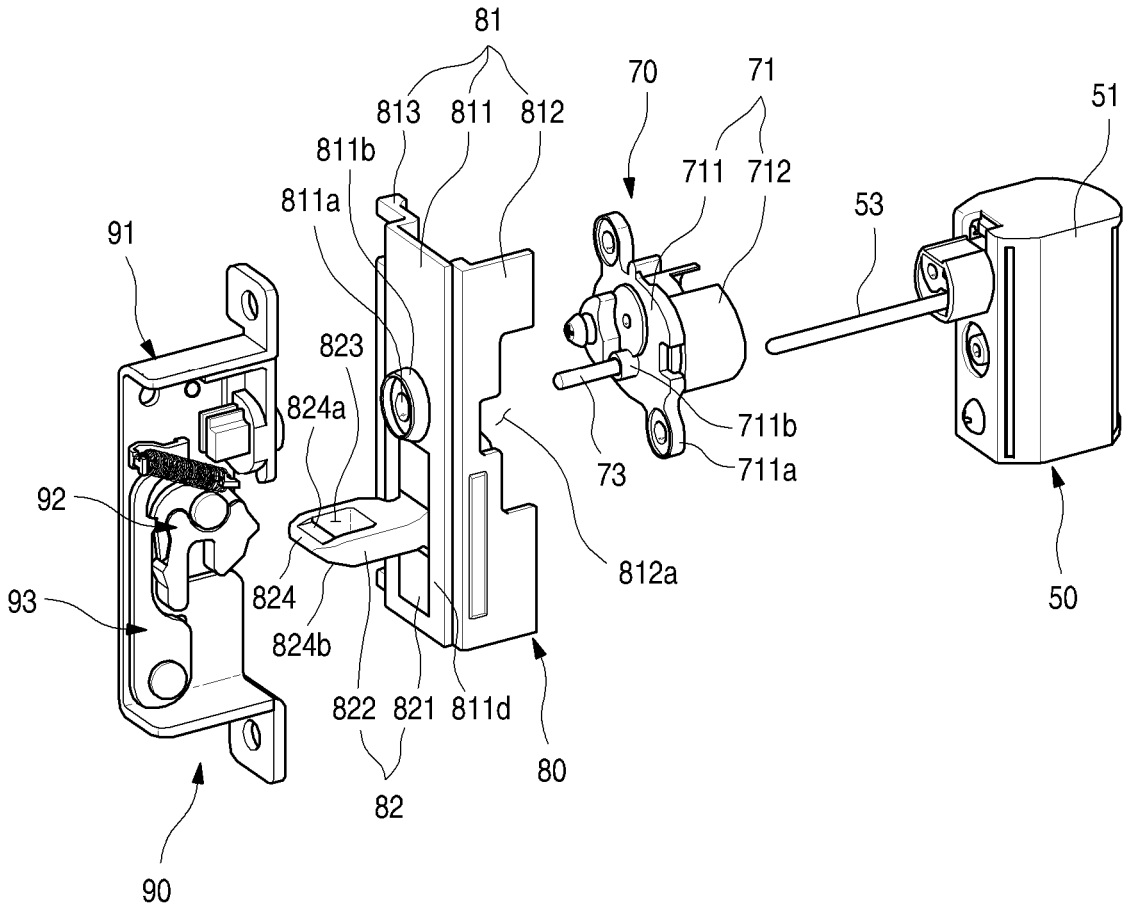
FIG. 8 is an exploded perspective view illustrating the door opening and closing apparatus viewed in another direction.

FIG. 6 is a perspective view illustrating a door opening and closing apparatus according to an embodiment of the present invention. FIG. 7 is an exploded perspective view illustrating the door opening and closing apparatus viewed from one direction. FIG. 8 is an exploded perspective view illustrating the door opening and closing apparatus viewed in another direction.

Hereinafter, the overall configuration of the door opening and closing apparatus 40 will be described with reference to the drawings.

The door opening and closing apparatus 40 refers to the entire structure for opening and closing and restraint of the sub-doo 22 and includes an operation device 50 which is provided on the handle 23, a restraint device 60 which is provided in the sub-door 22, and a latch device 90.

The operation device 50 is fixed to and mounted on the handle 23 and may include a button 52 which is elastically supported in the operation device case 51 and a first push rod 53 which is extended from the button 52 to the restraint device 60.

The restraint device 60 is provided in the sub-door 22, transfers the operation of the operation device 50 to the latch device 90 and at the same time can be selectively restrained with the latch device 90. The restraint device 60 may include the transfer unit 70 and the restraint unit 80. The transfer unit 70 and the restraint unit 80 are spaced apart from each other but may be configured to be in contact with the front and rear surfaces of the sub-door 22.

Specifically, the transfer unit 70 operates the latch device 90 in cooperation with the operation of the operation device 50 and includes a transfer unit case 71, a contact member 72, and a push rod 73.

The transfer unit case 71 forms an outer shape of the transfer unit 70 and at the same time allows the transfer unit 70 to be mounted on the sub-door 22 and may include a case base portion 711 and a case extension portion 712.

The case base portion 711 forms the bottom of the transfer unit 70 and includes a base fixing portion 711*a* protruding outwardly and can be fixed to the inside of the sub-door 22 by a coupling member such as a screw. The case extension portion 712 extends forward from the case base portion 711 and extends to be in contact with the rear surface of the plate forming the front surface of the sub-door 22. The contact member 72 may be accommodated in the case extension portion 712. A spring (not illustrated) may be provided on the inner side of the case extension portion 712 to elastically support the contact member 72. Therefore, the contact member 72 can be resiliently restored to an original position thereof after the pressing operation and in a state where no external force is applied, the contact member 72 may keep a state of being in contact with the front surface of the sub-door 22 or the first push rod 53.

A contact member rib 721 having a size corresponding to the front hole 221 may be formed on the front surface of the contact member 72 and the contact member rib 721 may be inserted into the inner side of the front hole 221 so that the contact member rib 721 can be exposed to the front surface of the sub-door 22. A contact portion 722 to be pressed by the first push rod 53 may be formed on the inner side of the contact member rib 721. The contact portion 722 may be formed in a shape corresponding to the end surface of the first push rod 53 and may be recessed from the front surface of the contact member 72.

Meanwhile, a second push rod 73 may be provided on the rear surface of the contact member 72. The second push rod 73 may be integrally formed with the contact member 72 and may be disposed behind the contact member 72 after being molded as a separate member.

The second push rod 73 can be moved backward together with the rearward movement of the contact member 72 when the operation device 50 is pressed. Accordingly, the extension length of the second push rod 73 can be formed as a length which can pass through the rear surface of the sub-door 22 and press the latch device 90 of the main-door 21 in a state where the second push rod 73 is moved backward.

Accordingly, the second push rod 73 is not in contact with the latch device 90 in a state where no external force is applied and the second push rod 73 can be moved backward to operate the latch device 90 when the first push rod 53 presses the contact member 72 by the operation of the operation device 50.

Meanwhile, the restraint unit 80 may be provided on a rear surface of the sub-door 22 for being selectively restrained with the latch device 90 and selectively keeping the sub-door 22 to a closed state. The restraint unit 80 may include a hook case 81 and a hook member 82.

The hook case 81 may be fixed to and mounted on the rear surface of the sub-door 22 with the hook member 82 fixed to and mounted thereon. The restraint unit 80 can include a first surface 811 which is exposed to the rear surface of the sub-door 22, a second surface 812 which is bent vertically from an end of the first surface 811, is brought into close contact with the side surface of the sub-door 22, and in which a cut-out portion 812*a* obtained by cutting a portion thereof is formed, and a third surface 813 which is formed to be stepped at a side opposite to the second surface 812 and on which a case screw hole 813*a* to which a screw S is fastened from an inside of the sub-door 22 is formed.

The first surface 811 may have a through-hole 811*a* through which the second push rod 73 goes in and out. The through-hole 811*a* may be formed in the case guide portion 811*b* protruding from the first surface 811. The case guide portion 811*b* has a circular cross section and may protrude rearward from the first surface 811 so as to have a predetermined height. The through-hole 811*a* may be formed at a center of the case guide portion 811*b*. Therefore, even when the second push rod 73 pushes the latch member 92 of the main-door 21 through the through-hole 811*a*, the second push rod 73 can be prevented from being exposed between the main-door 21 and the sub-door 22.

Meanwhile, a boss accommodation groove 811*c* may be formed on the rear surface of the first surface 811 on which the case guide portion 811*b* is formed so that the base boss 711*b* projecting from the case base portion 711 of the transfer unit 70 can be accommodated. The base boss 711*b* is formed through which the second push rod 73 is passed and is inserted into the boss accommodation groove 811*c* and thus can fix the transfer unit 70 more firmly and move the rod 73 more stable.

A hook member mounting portion 811*d* into which the hook member 82 is inserted under the through-hole 811*a* is mounted on the first surface 811 and the hook member 82 can be inserted into and mounted on the first surface 811. A screw boss 811*e* for fastening the screw S from the front of the hook member 82 is formed in the hook member mounting portion 811*d* and the hook member 82 is integrally fixed and mounted on the hook case 81 by the screw boss 811*e*.

The hook member 82 is inserted into the latch device 90 so that the hook member 82 can be restrained to the latch member 92 so that the sub-door 22 is fixed in a closed state. The hook member 82 may include a hook base 821 which is fixed to and mounted on the hook case 81 and a hook body 822 which protrudes from the hook base 821 and restrained to the latch member 92.

The hook base 821 is formed in a shape corresponding to the hook member mounting portion 811*d* and can be inserted into the hook member mounting portion 811*d*. The hook base 821 is fastened to the screw S passing through the screw boss 811*e* so that the hook member 82 is fixed integrally with the hook base 821.

The hook body 822 may protrude vertically rearward from the hook base 821, that is, the rear surface of the sub-door 22. The hook body 822 may be formed in a plate shape having a predetermined thickness and the hook body 822 may be formed with a hook opening 823 penetrating in the vertical direction.

The hook opening 823 is formed so as to insert one side of the latch member 92 in a state where the hook member 82 is inserted into the latch device 90 and the hook member 82 can be kept a state of being inserted into the latch device 90 by the latch member 92 which is inserted into the hook opening 823. Meanwhile, the rear end of the hook opening 823, that is, the rear end of the hook member 82 may be further formed with a restraint portion 824 which is engaged with the latch member 92.

The upper surface 824*a* and the lower surface 824*b* of the restraint portion 824 may be inclined, respectively. In other words, the upper surface 824*a* of the restraint portion 824 may be formed to be inclined and when the hook member 82 is moved forward, one side of the latch member 92 passes along the inclination of the upper surface 824*a*. The lower surface 824*b* of the restraint portion 824 may be also formed to be inclined so that the latch member 92 is inserted into the latch member 92 when the hook member 82 is inserted and at the same time, the latch member 92 can be pushed and rotated while being in contact with a side of the latch member 92.

The latch device 90 is disposed further rearward than the restraint device 60 and can be fixed to and mounted on the inside of the main-door 21. The latch device 90 may be shielded by the cover plate 24 while being mounted on the main-door 21 and the stopper member 93 and a portion of the latch member 92 can be disposed at a position corresponding to the plate hole 243 and the hook slot 242.

The latch device 90 generally includes a latch bracket 91 which allows the latch device 90 to be fixed to and mounted on the main-door 21 and simultaneously provides a space for accommodating a plurality of configurations, a latch member 92 which is mounted on the latch bracket 91 and selectively engaged with the hook member 82, a stopper member 93 which selectively limits the rotation of the latch member 92, and a push guide 94 which guides the push member 945 to be in contact with the stopper member 93.

Hereinafter, the structure of the latch device will be described in more detail with reference to the drawings.

Figure 9:
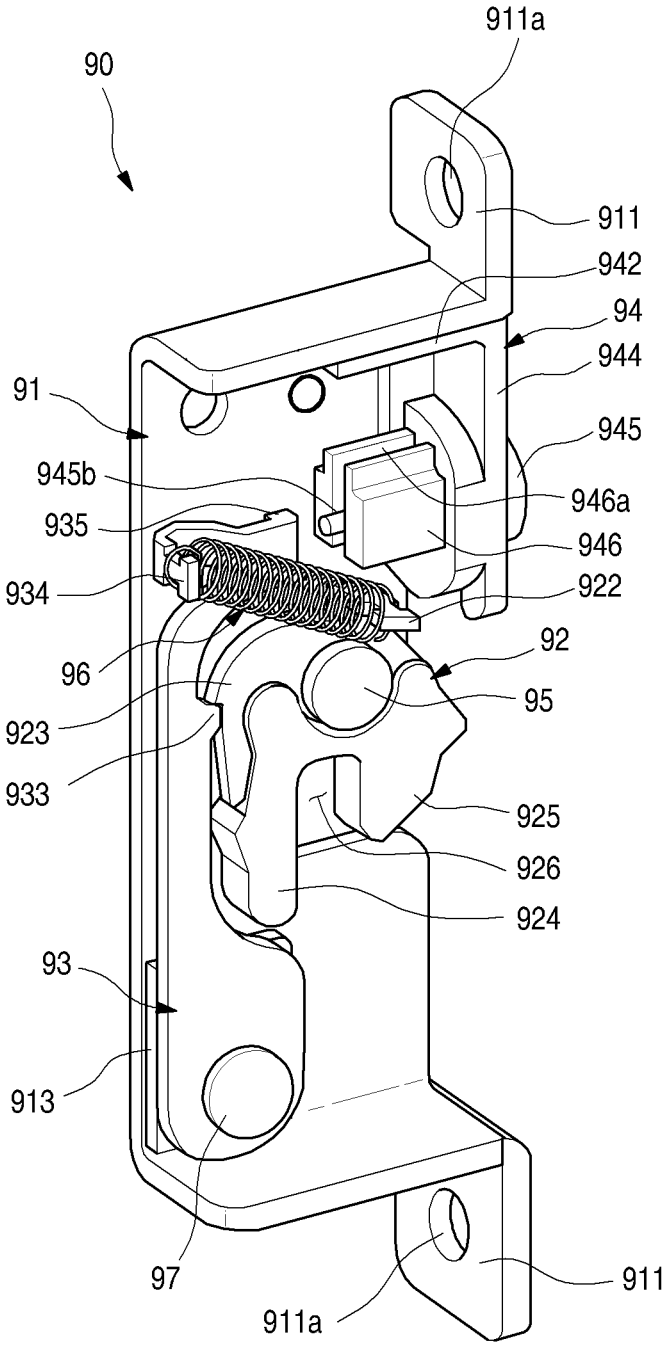
FIG. 9 is a perspective view illustrating the latch device.
Figure 10:
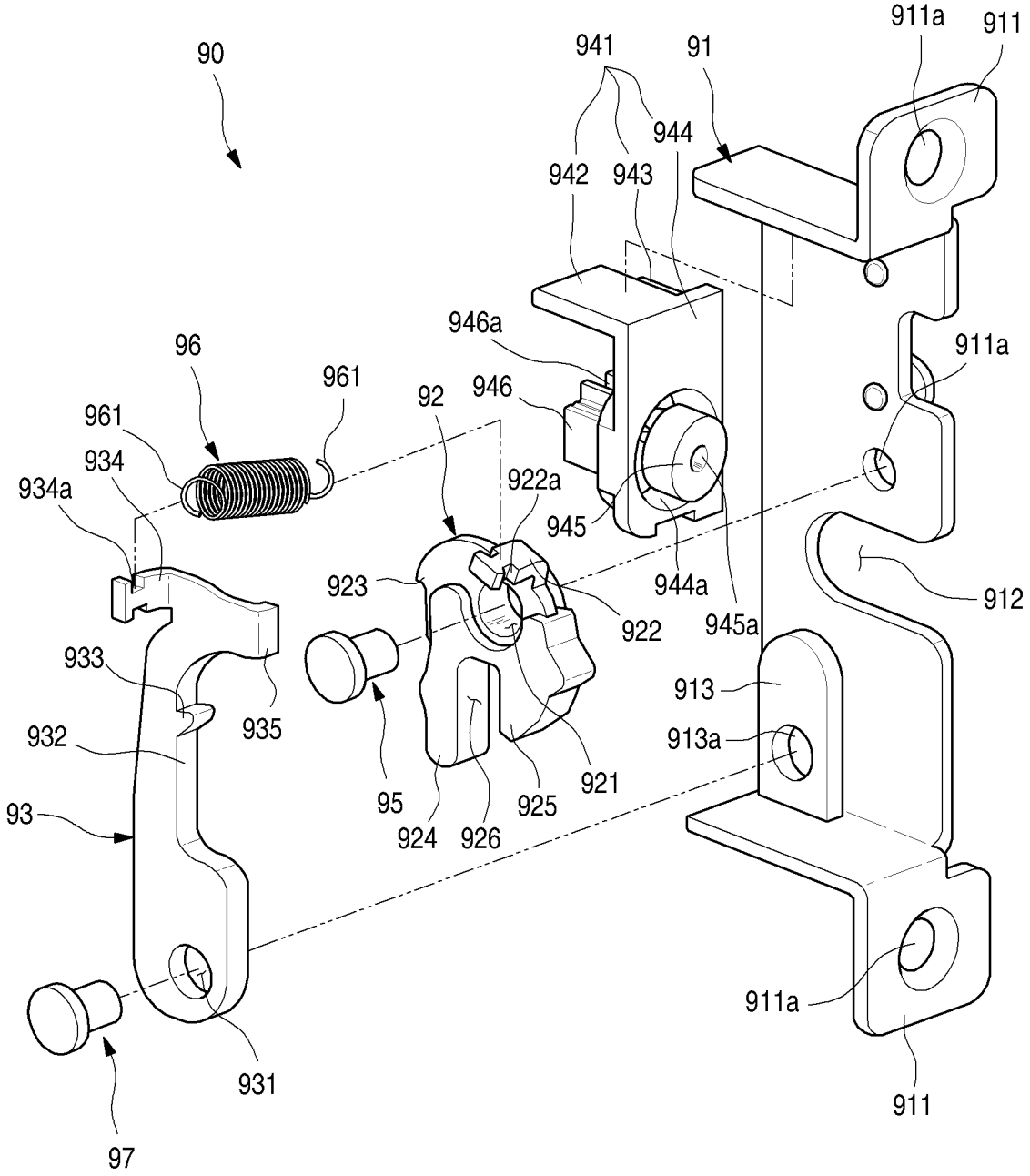
FIG. 10 is an exploded perspective view illustrating the latch device.

FIG. 9 is a perspective view illustrating the latch device. FIG. 10 is an exploded perspective view illustrating the latch device.

As illustrated, the latch device 90 includes the latch bracket 91 and has a structure that the latch member 92, the stopper member 93, and the push guide 94 can be mounted on the latch bracket 91.

Specifically, the upper end and the lower end of the latch bracket 91 may be formed in a bent shape. The upper and lower ends of the front surface of the latch bracket 91 may be bent to form the latch fixing portions 911, respectively. The latch fixing portion 911 may be seated in the latch device seating portion 218 in a state where the latch device 90 is accommodated in the latch device accommodation portion 216 of the main-door 21. A screw hole 911*a* is formed in the latch fixing portion 911 and the latch device 90 is fixed to the inside of the latch device accommodation portion 216 by the screw S which passes through and is fastened to the cover plate 24.

A bracket cutout portion 912 may be formed on a side surface of the latch bracket 91. The bracket cutout portion 912 is formed such that a portion of the latch bracket 91 is cut larger than the thickness of the hook member 82 so as to prevent interference with the hook member 82 when the hook member 82 goes in and out and can be cut rearward at the front end thereof at the same height as the hook member 82.

A stopper mounting portion 913 extending upward can be formed on the inner bottom surface of the latch bracket 91. The stopper member 93 is rotatably mounted on the stopper mounting portion 913 and the stopper mounting portion 913 is formed to be spaced apart or protrude from the side surface of the latch bracket 91. Accordingly, when the stopper member 93 is mounted, the stopper member 93 may be slightly spaced apart from the side surface of the latch bracket 91 and may be engaged with the latch member 92 and can be placed on a position that can be in contact with the rear end of the push member 945. In addition, the latch bracket 91 may further include a coupling hole 913*a* to which the stopper member rotation shaft 97 is coupled.

The latch member 92 can rotatably mount on the latch bracket 91 by selectively restraining the sub-door 22 by selective engagement with the hook member 82. The latch member 92 is formed with a latch hole 921 through which the latch rotation shaft 95 which is the rotation center of the latch member 92 passes. Accordingly, the latch member 92 is rotatable about the latch hole 921 and the latch member 92 can be a state of being mounted to be rotatable with respect to the latch bracket 91 by coupling of the latch rotation shaft 95 and the latch hole 921.

The latch rotation shaft 95 may be located at a position slightly higher than the center or the approximately center of the latch bracket 91. The latch rotation shaft 95 may be formed as a separate member and may be fastened to the coupling hole 91*a* of the latch bracket 91 after passing through the latch hole 921. Of course, the latch rotation shaft 95 may protrude to pass through the latch hole 921 from the latch bracket 91.

A first elastic member fixing portion 922 is formed on a front upper side with respect to the center of the latch hole 921 which protrudes a side of the latch member 92 and to which an end of the elastic member 96 is connected. The first elastic member fixing portion 922 may be bent perpendicularly at the outside end of the latch member 92. An annular groove 922*a* to which an annular portion 961 of the elastic member 96 can be engaged can be formed on the outer side of the first elastic member fixing portion 922 at positions facing each other. Therefore, in a case where the first elastic member fixing portion 922 is pulled by the elastic force of the elastic member 96, the latch member 92 can be rotated.

On the other hand, an engagement portion 923 which is formed by protruding or recessing one side of the latch member 92 and engages with the stop protrusion 933 of the stopper member 93 can be formed on the rear side with respect to the center of the latch hole 921. The engagement portion 923 is for restraining the rotation of the latch member 92 by the elastic force of the elastic member 96 and is engaged with the stop protrusion 933 protruding from the stopper member 93 and thus can restrain so that the latch member 92 is not rotated.

Meanwhile, a first protrusion portion 924 and a second protrusion portion 925 and a hook accommodation portion 926 between the first protrusion portion 924 and the second protrusion portion 925 are formed below with respect to the center of the latch hole 921. The first protrusion portion 924 may be located further rearward than the second protrusion portion 925 and may have a longer length than the second protrusion portion 925.

The hook accommodation portion 926 may be positioned at a space between the first protrusion portion 924 and the second protrusion portion 925. The width of the hook accommodation portion 926 may be sized so that the end portion of the hook member 82, that is, the restraint portion 824 can be accommodated. The entire thickness of the latch member 92 may be sized to be inserted into the hook opening 823 of the hook member 82.

When the latch member 92 rotates in the counterclockwise direction due to the structure described above, the front end of the hook member 82 positioned inside the hook accommodation portion 926, that is, the restraint portion 824 can exit the hook accommodation portion 926 and pass through the end portion of the second protrusion portion 925 to exit the hook slot 242.

On the contrary, when the hook member 82 is inserted, if the restraint portion 824 is inserted into the hook slot 242, then the end portion of the restraint portion 824 passes the end portion of the second protrusion portion 925 and is introduced into the hook accommodation portion 926 to press the first protrusion portion 924 to rotate the latch member 92 in the clockwise direction.

Meanwhile, the stopper member 93 may be provided on the inner side of the latch bracket 91 behind the latch member 92. The stopper member 93 may extend from the lower portion of the latch bracket 91 through the latch member 92 to the rear side of the push guide 94. A stopping hole 931 may be formed at the lower end of the stopper member 93. The stopping hole 931 may be positioned below and behind the latch hole 921. The stopper member 93 may be configured to be rotated in the same direction as the rotation direction of the latch member 92 when the restraint with the latch member 92 is released.

The stopping hole 931 is penetrated by a stopper member rotation shaft 97 serving as a rotation center of the stopper member 93 so that the stopper member 93 can be rotatably mounted. The stopper member rotation shaft 97 may be formed as a separate member and may be fastened to the stopper mounting portion 913 of the latch bracket 91 after passing through the stopping hole 931. Of course, the stopper member rotation shaft 97 may have a structure that protrudes to pass through the stopping hole 931 from the latch bracket 91.

A recessed portion 932 may be formed on the upper side of the stopping hole 931 so that a surface facing the latch member 92 is recessed inward. The recessed portion 932 may be cut in such a manner that the latch member 92 and the stopper member 93 do not interfere with each other even by the rotation of the latch member 92 or the rotation of the stopper member 93.

A stop protrusion 933 protruding toward the engagement portion 923 of the latch member 92 may be formed at one side of the recessed portion 932. The stop protrusion may protrude from one side of the recessed portion 932 while the lower surface of the stop protrusion may be inclined and the upper surface thereof may form a surface which is engaged with the engagement portion 923. Therefore, both the latch member 92 and the stopper member 93 can be kept in a restrained state without all the latch member 92 and the stopper member 93 being rotated in a state where the stop protrusion 933 and the engagement portion 923 are engaged with each other.

A second elastic member fixing portion 934 may be formed at a rear end of the upper end of the stopper member 93 so that the upper end of the stopper member 93 protrudes to connect with one end of the elastic member 96. The second elastic member fixing portion 934 may be bent vertically at the rear end of the stopper member 93. The second elastic member fixing portion 934 may be bent in the same direction as a direction in which the first elastic member fixing portion 922 is bent.

Annular grooves 934*a* to which an annular portion 961 of the elastic member 86 can be engaged can be formed on the outer side of the second elastic member fixing portion 934 at positions facing each other, respectively. Therefore, in a case where the second elastic member fixing portion 934 is pulled by the elastic force of the elastic member 96, the stopper member 93 can be rotated.

The elastic member 96 may be constituted as a tension spring, connects between the first elastic member fixing portion 922 and the second elastic member fixing portion 934 so that the latch member 92 and the stopper member 93 can be returned to the initial position after being rotated by an external force. To this end, the annular portions 961 at both ends of the elastic member 96 are fixed to the first elastic member fixing portion 922 and the second elastic member fixing portion 934 and the latch member 92 and the stopper member 93 can be interlocked with each other.

Of course, a plurality of elastic members 96 may be provided and each may be configured to rotate the latch member 92 and the stopper member 93. In addition, the elastic member 96 may be formed of another member that provides elasticity other than a tension spring.

On the other hands, a contact portion 935 may be formed on the front end of the upper end of the stopper member 93 to provide a surface with which the rear end of the push member 945 is in contact. The contact portion 935 may be bent in a direction opposite to the second elastic member fixing portion 934, may be disposed on the same extension line as the push member 945 so that the contact portion 935 may be configured to be selectively pressed by push member 945 when the push member 945 is moved forward or backward.

The push guide 94 may be formed in front of the contact portion 935. The push guide 94 is movably mounted in the front and rear directions to guide the push member 945 in the front and rear directions.

The push guide 94 is provided at the inside upper end of the latch bracket 91 and is provided in front of the contact portion 935 so that the rear end of the push member 945 moves toward the contact portion from the correct position.

The push guide 94 may include a guide case 941 which is fixed to and mounted on the latch bracket 91 and a push member 945 which is mounted on the guide case 941 and is movably mounted on the guide case 941 in the front and rear direction.

The guide case 941 may further include a spring (not illustrated) for elastically supporting the push member 945 and returning the push member 945 to an original position thereof after the push member 945 is moved backward.

The guide case 941 includes an upper surface 942, a side surface 943, and a front surface 944 and the upper surface 942 is in contact with the upper inside surface of the latch bracket 91, the side surface is in contact with an outside surface of the latch bracket, and can be fixedly coupled to the latch bracket by a screw. The front surface 944 of the guide case 941 can shield a portion of the opened front surface of the latch bracket 91. In addition, the front surface of the guide case 941 may have a front hole 944*a* in which the push member 945 is accommodated.

The push member 945 is located inside the front hole 944*a* and may be elastically supported by the spring so as to protrude somewhat forward from the front surface 944 of the guide case 941. Therefore, the push member 945 is in a state of protruding to be exposed through the plate hole 243 of the cover plate 24. In this state, the push member 945 is pressed together when the second push rod 73 is moved backward so that the push member 945 can be moved backward immediately.

The push member 945*b* is formed with a pushing portion 945*b* that extends rearward and the pushing portion 945*b* passes through the push guide 946 formed in the guide case 941 and can be in contact with the contact portion 935. The pushing portion 945*b* is extended so as to protrude to the rear end of the push guide 946 and has a length which can release the restraint of the latch member 92 by pushing the contact portion in a state where the push member 945 is pressed.

Meanwhile, a load groove 945*a* into which the rear end of the second push rod 73 can be inserted is formed on a front surface of the push member 945 and when the second push rod 73 is moved backward, the rear end of the second push rod 73 pushes the push member 945 backward in a state of being inserted into the rod groove 945*a*.

The push guide 946 may extend rearward from the front surface 944 of the guide case 941 to a position adjacent to the front end of the stopper member 93, that is, the contact portion 935. The push guide 946 may be integrally formed with the front surface 944 of the guide case 941. The push guide 946 may be formed with a guide passage 946*a* through which the pushing portion 945*b* extending from the push member 945 passes.

The guide passage 946*a* can be positioned to face the contact portion 935. Accordingly, when the second push rod 73 is moved backward the pushing portion 945*b* of the push member 945 is moved by a guide of the push guide 946, pushes the contact portion 935 and thus the pushing rod 73 can cause the stopper member 93 to be rotated, and the latch member can be rotated due to restraint release of the stopper member 93 and the latch member 93.

Hereinafter, the operation of the door opening and closing apparatus according to the embodiment of the present invention having a structure described above will be described in detail with reference to the drawings.

Figure 11:
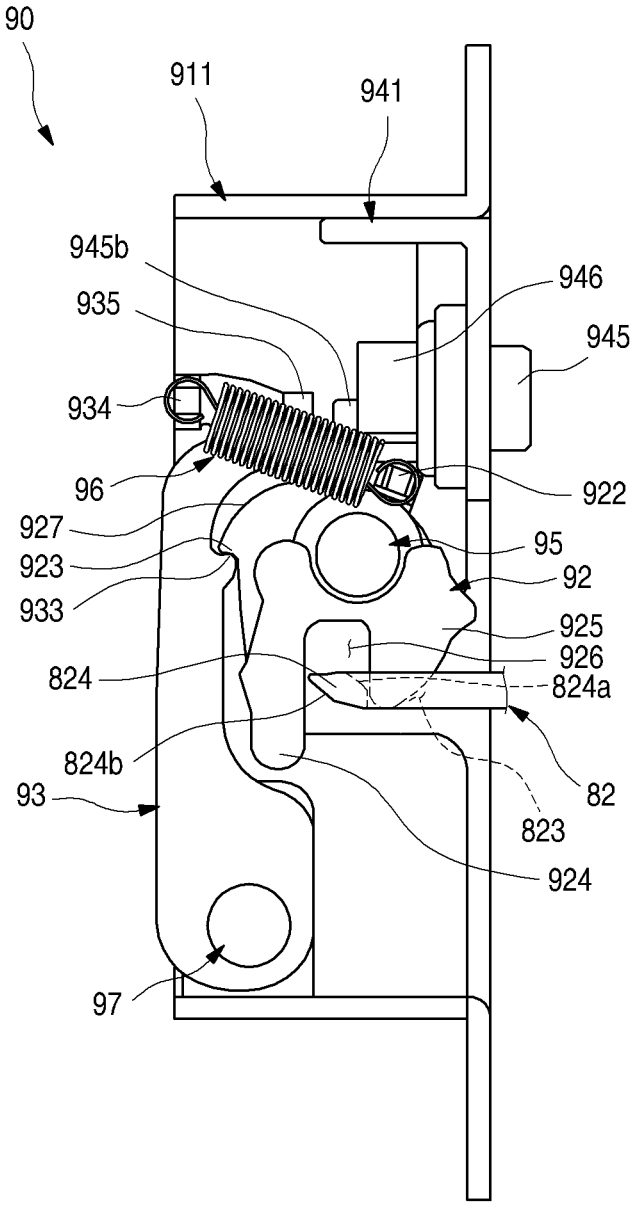
FIG. 11 is a diagram illustrating a state of the latch device in a state where the sub-door is closed.

FIG. 11 is a diagram illustrating the state of the latch device in a state where the sub-door is closed.

As illustrated in drawings, the hook member 82 is in a state of being inserted into the hook accommodation portion 926 of the latch member 92 in a state where the sub-door 22 is closed. At this time, the second protrusion portion 925 of the latch member 92 is in a state of being inserted into the hook opening 823, so that the restraint portion 824 and the second protrusion portion 925 are in a state of being engaged with each other. The stop protrusion 933 and the engagement portion 923 of the latch member 92 are also engaged with each other while being in contact with each other so that the latch member 92 and the stopper member 93 are not rotated and thus are maintained in a state of being engaged.

In such a state, when the user pulls the handle 23, the restraint portion 824 of the hook member 82 pulls the second protrusion portion 925, and the latch member 92 is rotated by the moment in the clockwise direction.

However, since the rotation of the latch member 92 in the counterclockwise direction is limited by the restraint of the stop protrusion 933 and the engagement portion 923 of the stopper member 93, the hook accommodation portion 926 of the latch member 92 is kept in a state of being restrained in engagement with the restraint portion 824 of the hook member 82.

Therefore, even if the user pulls the handle 23, the main-door 21 and the sub-door 22 are kept in a state of being engaged with each other, and the main-door 21 and the sub-door 22 are in a state of being coupled to each other, that is, the entire refrigerating chamber door 21 can be opened.

In order for the user to open the main-door 21 and store the food in the refrigerating chamber 11, in a state where the hook member 82 is kept in a state of being restrained by the latch device 90, the refrigerating chamber door 21 can be opened while holding the refrigerating chamber door 23.

Figure 12:
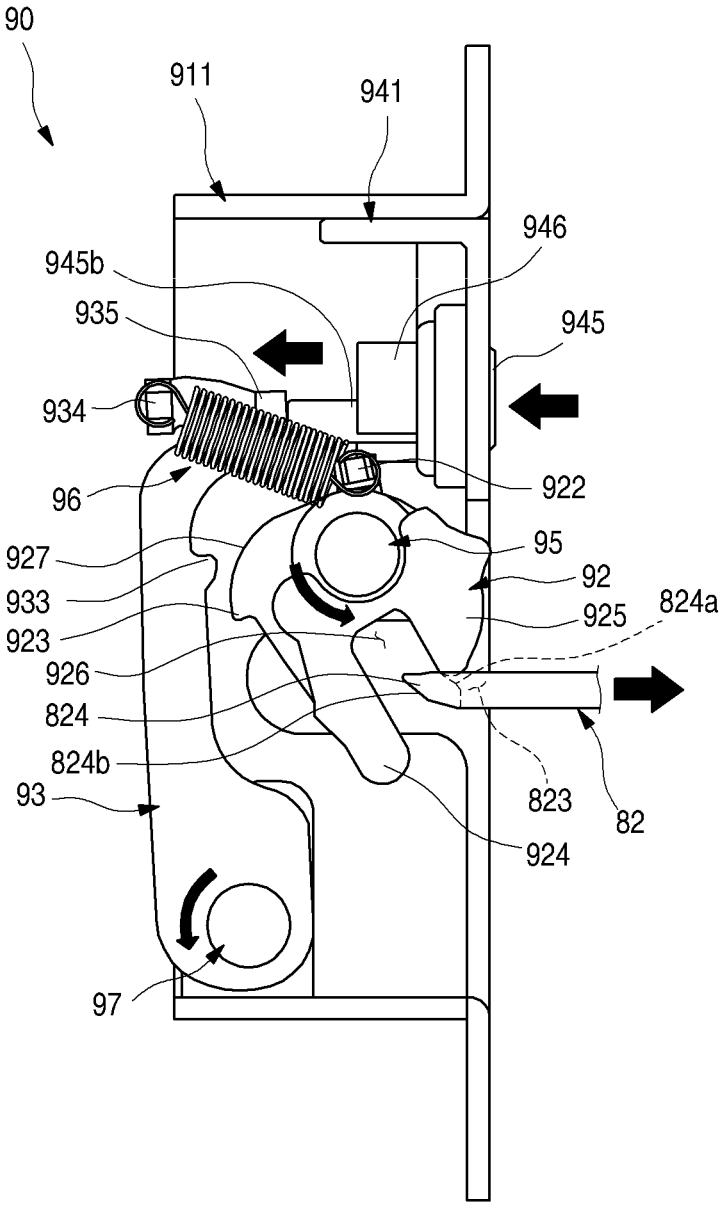
FIG. 12 is a diagram illustrating a state of the latch device in a state where the sub-door is opened.

FIG. 12 is a diagram illustrating the state of the latch device in a state where the sub-door is opened.

As illustrated in the drawing, the restraint between the hook member 82 and the latch device 90 can be released by the operation of the user and can be separated from the latch device 90 and, in this state, the main-door 21 is closed and only the sub-door 22 is rotated to open the door storage space 212 on the main-door 21.

Specifically, in order to open the sub-door 22, the user pulls the handle 23 while holding the handle 23 to open the sub-door 22.

At this time, the handle 23 can be pulled while pressing the button 52 provided on the handle 23. The first push rod 53 pushes the contact member 72 of the transfer unit 70 by the pushing operation of the button 52. Accordingly, the first push rod 53 and the second push rod 73 of the contact member 72 are simultaneously moved rearward. As a result, the rear end of the second push rod 73 pushes the push member 945 located on the front surface of the push member 945.

When the push member 945 is pushed by the second push rod 73, the pushing portion 945*b* of the push member 945 moves backward and the rear end of the pushing portion 945*b* pushes the contact portion 935 backward while being in contact with the contact portion 935.

In other words, the stopper member 93 is rotated in the counterclockwise direction by the pushing portion 945*b*. Since the stopper member 93 and the latch member 92 are in a state of being connected by the elastic member 96, when the stopper member 93 is rotated, the latch member 92 is also rotated in the same counterclockwise direction as the stopper member 93 by applying a force to pull the first elastic member fixing portion 922 by the elastic force of the elastic member 96.

At this time, when the stopper member 93 is rotated counterclockwise by a predetermined angle, the stop protrusion 933 and the engagement portion 923 may be separated from each other to be released from the restraint, and the latch member 92 is rotated in the counterclockwise direction.

In this state, the user can operate the hook member 82 to come out of the hook accommodation portion 926 of the latch member 92 in a state where the latch member 92 is completely released from the restraint. In other words, in a state where the latch member 92 is released from the restraint, the sub-door 22 rotates when the user grasps and pulls the handle 23, and in a state where the sub-door is opened by being rotated by a predetermined angle or more, the hook member 82 is naturally moved to the outside of the hook accommodation portion 926.

The inclined portion of the upper surface 824*a* of the restraint portion 824 may be in contact with the second protruding portion 925 of the latch member 92 during the forward movement of the hook member 82, and the restraint portion 824 further rotate the latch member 92 in the counterclockwise direction to allow the hook member 82 to exit the hook accommodation portion 926 through the second protrusion portion 925.

The sub-door 22 can be opened independently by opening the sub-door 22 by operating the operation device 50 and in a state where the sub-door 22 is opened, the door storage space 212 of the main-door 21 is exposed to the outside so that the user can store the food in the door storage space 212.

Figure 13:
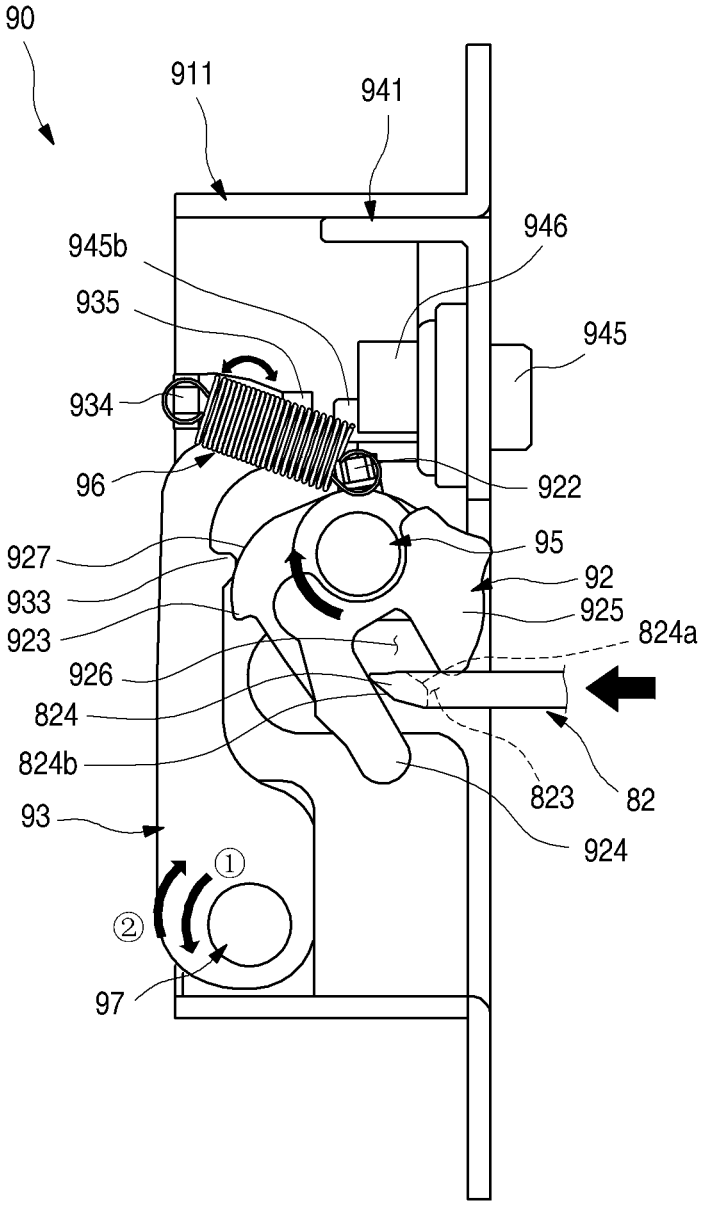
FIG. 13 is a view illustrating the state of the latch device immediately before the sub-door is closed after the sub-door is opened.

FIG. 13 is a view illustrating the state of the latch device immediately before the sub-door is closed after the sub-door is opened.

As illustrated, in a state where the sub-door 22 is opened by the operation of the operation device 50, the latch member 92 is in a state of being rotated in the counterclockwise direction when compared with FIG. 11, as illustrated in FIG. 13 and the stopper member 93 is in a state where it is not restrained with the stopper member 93.

At this time, the stop protrusion 933 of the stopper member 93 is positioned on a curved surface portion 927 above the engagement portion 923 of the latch member 92. The curved surface portion 927 forms an outside surface of the latch member 92 above the latch hole 921 of the latch member 92 and is connected to the engagement portion 923 at a predetermined curvature. Therefore, since the restoring force is applied between the stopper member 93 and the latch member 92 by the elastic member 96, the stop protrusion 933 can be kept in a state of being in contact with the curved surface portion 927 as long as no external force is applied thereto.

The latch member 92 is rotated in a counterclockwise direction by the elastic force of the elastic member 96 so that at least a portion of the opened end portion of the hook accommodation portion 926 can be disposed to be toward the hook slot 242.

Meanwhile, in this state, when the user closes the sub-door 22, the hook member 82 protruding from the rear surface of the sub-door 22 passes through the hook slot 242 and moves toward the opened portion of the hook accommodation portion 926 of the latch member 92.

When the sub-door 22 is closed by a predetermined angle, the lower surface 824*b* of the restraint portion 824 of the hook member 82 pushes the first protrusion portion 924 while being in contact with the inside surface of the first protrusion portion 924 of the latch member 92. When the first protrusion portion 924 is pushed, the latch member 92 starts to rotate in the clockwise direction by the moment and rotates until the sub-door 22 is completely closed.

The stopper member 93 comes into contact with the latch member 92 by the elastic force of the elastic member 96 when the latch member 92 rotates in a clockwise direction. Particularly, the stop protrusion 933 is moved toward the engagement portion 923 along the curved surface portion 927 by the clockwise rotation of the latch member 92.

The stopper member 93 is rotated in a counterclockwise direction (① direction in FIG. 13) while the stop protrusion 933 is moved along the curved surface portion 927 and the latch member is rotated in the clockwise direction. At this time, the elastic member 96 is in a state where the latch member 92 and the stopper member 93 are rotated and pulled in different directions from each other.

When the sub-door 22 is completely closed, the hook member 82 is moved as far as possible rearward and in this state, the latch member 92 can be as illustrated in FIG. 11.

In other words, when the stopper member 93 is rotated in a counterclockwise direction until the stop protrusion 933 is positioned at the engagement portion 923, the hook member 82 becomes a state of being fully accommodated in the hook member 82. When the stop protrusion 933 extends beyond the end portion of the curved surface portion 927, the stopper member 93 is rotated in the clockwise direction (in ② direction in FIG. 13) by the restoring force of the elastic member 96 and the stop protrusion 933 and the engagement portion 923 are in engagement with each other and restrained to each other as illustrated in FIG. 11.

In this state, the restraint portion 824 is accommodated in the hook accommodation portion 926, and rotation of the latch member 92 is restrained by the stopper member 93. Accordingly, the hook member 82 becomes a state illustrated in FIG. 11 in which the hook member 82 is kept a state of being restrained inside of the latch member 92 and the sub-door 22 is kept a state of being completely closed by the main-door 21.

On the other hand, the present invention is not limited to the embodiments described above and various other embodiments will be possible.

Another embodiment of the present invention is characterized in that the refrigerator cabinet is provided with a latch device, a door is provided with a restraint device, and a handle of the door is provided with an operation device. Since only the mounting position of the door opening and closing apparatus of the refrigerator according to another embodiment of the present invention is different from that of this embodiment and the structure thereof is identical to that of this embodiment, the detailed description thereof will be omitted and the same reference numerals will be used.

Figure 14:
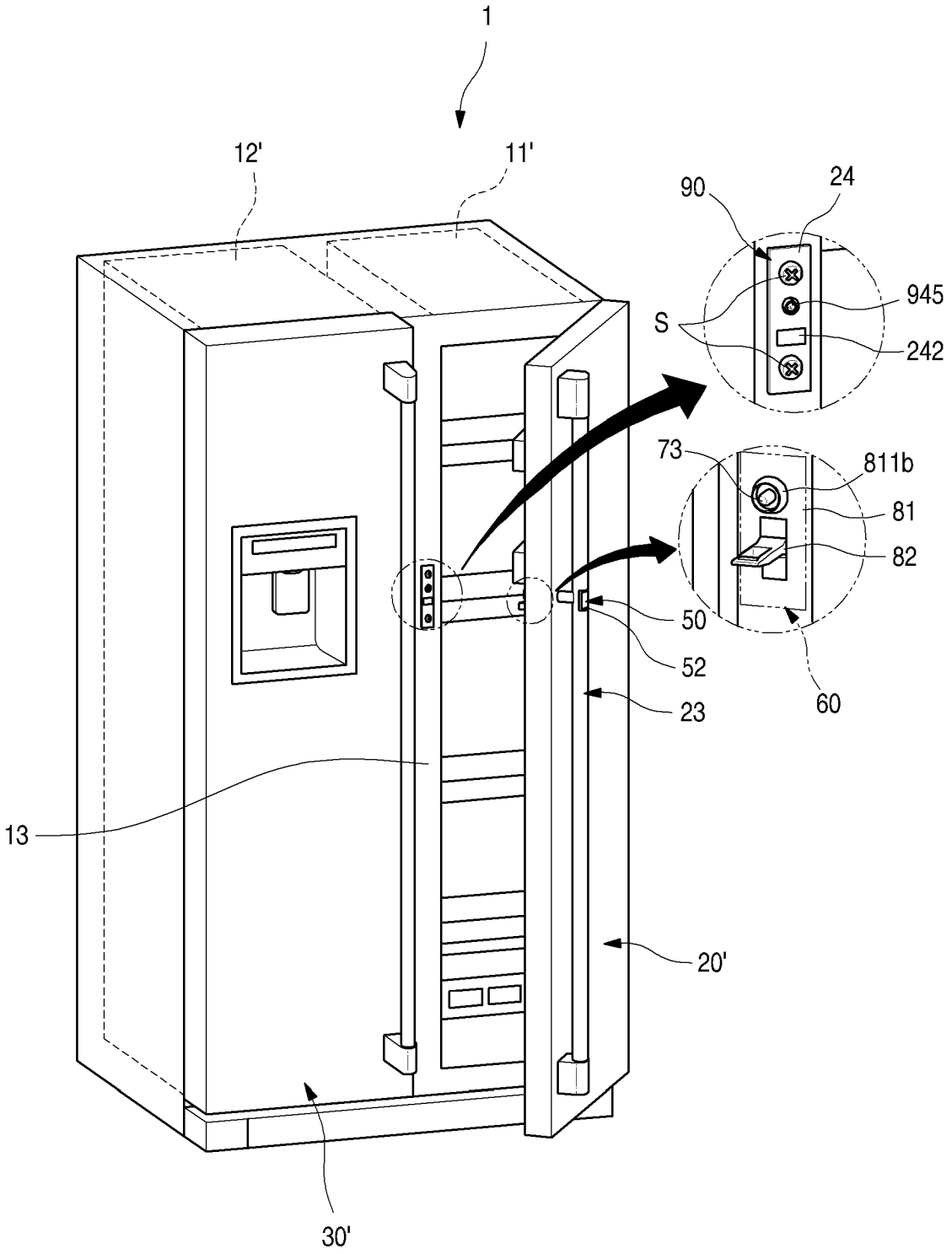
FIG. 14 is a perspective view of a refrigerator according to another embodiment of the present invention.

FIG. 14 is a perspective view of a refrigerator according to another embodiment of the present invention.

As illustrated in the drawing, an outer appearance of the refrigerator 1 according to another embodiment of the present invention may be shaped by a cabinet 10 forming a storage space and doors 20' and 30' opening and closing the storage space.

A barrier 13 for partitioning the storage space may be formed in the cabinet 10 and a refrigerating chamber 11' and a freezing chamber 12' may be disposed on the left and right sides of the cabinet 10 by the barrier 13.

The doors 20' and 30' may include a refrigerating chamber door 20' and a freezing chamber door 30' that independently open and close the refrigerating chamber 11' and the freezing chamber 12' and the refrigerating chamber door 20' and the freezing chamber door 30' can be rotatably mounted on the cabinet 10, respectively.

A handle 23 can be provided on the front surface of the refrigerating chamber door 20' and the freezing chamber door 30' so that the user can grip the doors 20' and 30' for opening and closing the doors 20' and 30'. Accordingly, the user can open and close the refrigerating chamber 11' and the freezing chamber 12' by rotating the doors 20' and 30' while holding the handle 23.

On the other hand, an operation device 50 that is pressed by a user can be provided on one side of the handle 23. The operation device 50 may include a button 52 that is exposed to the front surface of the handle 23 by a user's pressing operation for opening the refrigerator door 20'.

The restraint device 60 may be provided on the rear surface of the refrigerating chamber door 20' corresponding to the position of the operation device 50. The restraint device 60 may include the hook case 81 and the hook member 82. A through-hole 811*a* through which the second push rod 73 goes in and out may be formed above the hook member 82. The through-hole 811*a* may be formed in the case guide portion 811*b* protruding from the hook case 81.

On the other hand, a latch device 90 may be provided on the front surface of the barrier 13 corresponding to the operation device 50. The latch device 90 may be provided at a position corresponding to the operation device 50 provided on the handle 23 of the refrigerating chamber door 20'. Accordingly, the operation of the latch device 90 becomes possible according to the operation of the operation device 50 and the refrigerating chamber door 20' can be selectively restrained and opened.

In addition, the cover plate 24 shields the latch device 90. The cover plate 24 may be formed with a fastening hole 241 to which the screw S is fastened.

In addition, a hook slot 242 through which the hook member 82 for selectively restraining the refrigerating chamber door 20' may go in and out may be formed between the fastening holes 241. The hook slot 242 may be formed at a corresponding position so that the hook member 82 can be selectively restrained with the latch member 92.

A plate hole 243 may be formed between the hook hole 241 adjacent to the hook slot 242. The plate hole 243 is formed to expose the push member 945 of the latch device 90 and may be formed at a corresponding position so as to force the operation of the stopper member 93.

On the other hand, the present invention is not limited to the embodiments described above, and various other embodiments will be possible.

Another embodiment of the present invention is characterized in that a button is provided on a front surface of the sub-door. Since only the mounting position of the door opening and closing apparatus of the refrigerator according to another embodiment of the present invention is different from that of this embodiment and the structure thereof is identical to that of this embodiment, the detailed description thereof will be omitted and the same reference numerals will be used.

Figure 15:
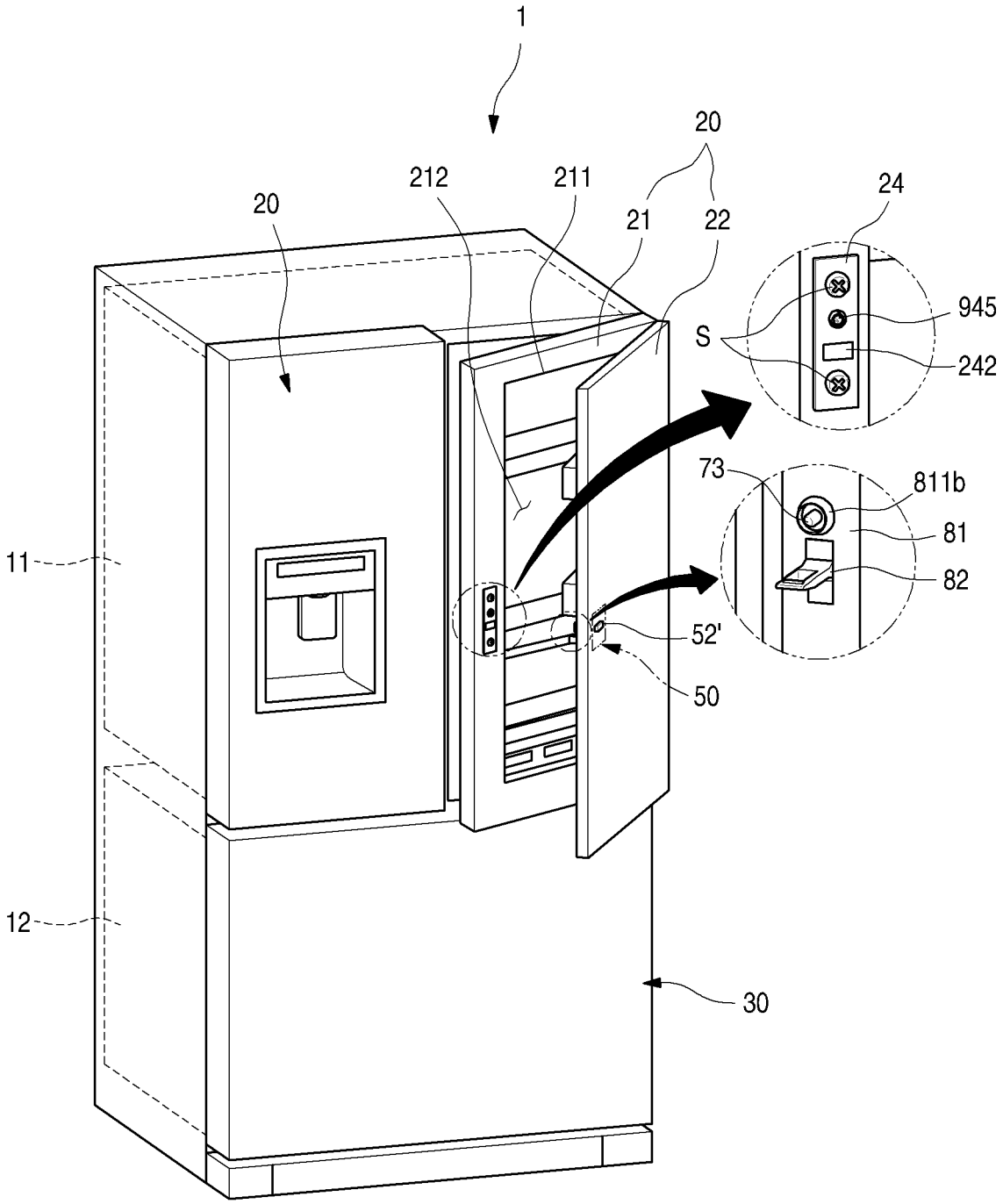
FIG. 15 is a perspective view of a refrigerator according to another embodiment of the present invention.

FIG. 15 is a perspective view of a refrigerator according to another embodiment of the present invention.

An outer appearance of the refrigerator 1 according to the embodiment of the present invention may be shaped by a cabinet 10 forming a storage space and a door opening and closing the storage space.

The inside of the cabinet 10 is divided into upper and lower portions to form the freezing chamber 12 and the refrigerating chamber 11, respectively. The refrigerating chamber 11 on the upper portion of the cabinet 10 may be configured to be opened and closed by a pair of refrigerating chamber doors 20. The refrigerating chamber door 20 may be rotatably mounted on both sides of the front surface of the cabinet 10. The freezing chamber door 30 may be configured to go in and out in the form of a drawer in the cabinet 10 and may be configured to open and close the freezing chamber 12 by sliding in and out.

Meanwhile, the refrigerating chamber door 20 may include a main-door 21 and a sub-door 22. The main-door 21 is rotatably coupled to the cabinet 10 to open and close the refrigerating chamber 11. The sub-door 22 is rotatably coupled to the main-door 21 to open and close the door storage space 212 formed in the main-door 21.

To this end, the main-door 21 is formed with an opening portion 211 to form the door storage space 212. The opening portion 211 can be selectively opened and closed by the rotation of the sub-door 22.

The sub-door 22 forms the outer appearance of the front surface of the refrigerating chamber door 20 and may be configured to shield the entire front surface of the main-door 21.

An operation device 50 may be provided at a side remote from the rotation shaft of the sub-door 22 among a front side of the sub-door 22. An operation device 50 may be provided. The operation device 50 may include a button 52' that is exposed to the front surface of the sub-door 22 by a user's pressing operation to open the sub-door 22.

The restraint device 60 may be provided on the rear surface of the sub-door 22 corresponding to the position of the operation device 50. The restraint device 60 may include the hook case 81 and the hook member 82. A through-hole 811*a* through which the second push rod 73 goes in and out may be formed above the hook member 82. The through-hole 811*a* may be formed in the case guide portion 811*b* protruding from the hook case 81.

Meanwhile, a latch device 90 may be provided on the front surface of the main-door 21 corresponding to the operation device 50. The latch device 90 may be provided at a position corresponding to the operation device 50 provided in the sub-door 22. Accordingly, the operation of the latch device 90 becomes possible according to the operation of the operation device 50 and the sub-door 22 can be selectively restrained and opened.

In addition, the cover plate 24 shields the latch device 90. The cover plate 24 may be formed with a fastening hole 241 to which the screw S is fastened.

In addition, a hook slot 242 through which the hook member 82 for selectively restraining the sub-door 22 goes in and out may be formed between the fastening holes 241. The hook slot 242 may be formed at a corresponding position so that the hook member 82 can be selectively restrained with the latch member 92.

A plate hole 243 may be formed between the hook slot 242 and the hook slot 242 and the hook hole 241 adjacent to the hook slot 242. The plate hole 243 is formed to expose the push member 945 of the latch device 90 and may be formed at a corresponding position so as to force the operation of the stopper member 93.

Meanwhile, in order to open the refrigerating chamber door 20 and the main-door 21 on the left side, the refrigerating chamber door 20 and the main-door 21 can be rotated by inserting their hand into the handle groove recessed in the lower end of the refrigerating chamber door 20 and the main-door 21.

What is claimed is:

1. A refrigerator comprising:

a cabinet that defines a storage space;

a main-door configured to open and close at least a portion of the storage space, the main-door defining an opening;

a sub-door configured to open and close the opening;

a restraint device that protrudes from a rear surface of the sub-door;

a latch device that is located at the main-door and that is configured to receive the restraint device and selectively restrict movement of the restraint device from the latch device; and an operation device that is located at the sub-door and that includes a button exposed at a front side of the sub-door and configured to, based on operation by a user, release the restraint device from the latch device, wherein the latch device comprises:

a latch configured to rotate about a first rotation shaft and restrict movement of the restraint device from the latch based on rotation of the latch about the first rotation shaft, a stopper that extends from a second rotation shaft located vertically below the first rotation shaft in an upward direction toward an upper end of the latch, the stopper being configured to rotate about the second rotation shaft and engage a side of the latch to limit movement of the latch, an upper end of the stopper being located vertically above the upper end of the latch, a pusher located at an upper side of the latch and configured to, based on operation of the operation device, push an upper portion of the stopper located vertically above the upper end of the latch to cause the stopper to rotate about the second rotation shaft, and an elastic member connected to the latch and to the stopper, and configured to provide force to allow the latch and the stopper to contact each other, wherein the pusher is configured to, based on the user operating the operation device to open the sub-door, push the upper portion of the stopper to rotate the stopper about the second rotation shaft in a rotation direction, and wherein the latch is configured to, based on the rotation of the stopper about the second rotation shaft in the rotation direction, rotate about the first rotation shaft in the rotation direction of the stopper and release restraint between the latch and the stopper.

2. The refrigerator according to claim 1, wherein the operation device further includes a push rod that extends from the button toward a rear side of the sub-door and that is configured to operate the pusher.

3. The refrigerator according to claim 1, wherein the restraint device includes:

a transfer unit configured to, based on operation of the button, move to press the pusher; and a hook member that protrudes rearward from the rear surface of the sub-door, the hook member defining a hook opening that is configured to, based on the rotation of the latch about the first rotation shaft, receive a portion of the latch to restrict movement of the hook member from the latch.

4. The refrigerator according to claim 1, wherein the latch device further comprises:

a first elastic member fixing portion that protrudes from the latch and that is located vertically above the first rotation shaft of the latch; and a second elastic member fixing portion that protrudes from a side of the stopper and that is located vertically above the first elastic member fixing portion, and wherein the elastic member connects the first elastic member fixing portion and the second elastic member fixing portion to each other.

5. The refrigerator according to claim 4, wherein the elastic member includes a tension spring that has a first end configured to couple to the first elastic member fixing portion, and a second end configured to couple to the second elastic member fixing portion.

6. The refrigerator according to claim 4, wherein the stopper includes a stop protrusion that protrudes from a side of the stopper toward the latch, wherein the latch includes an engagement portion that protrudes from the side of the latch toward the stopper, and wherein the stop protrusion is configured to, based on the latch receiving an end portion of the restraint device, be engaged to the engagement portion and restrict movement of the latch from the stopper.

7. The refrigerator according to claim 6, wherein the latch includes a curved surface portion that is curved along an outside surface of the latch toward the engagement portion, and wherein the stop protrusion is configured to move relative to the latch in contact with the curved surface portion based on the rotation of the latch about the first rotation shaft.

8. The refrigerator according to claim 6, wherein the elastic member has a first end and a second end, and wherein the first rotation shaft, the second rotation shaft, the stop protrusion, and the engagement portion are located in an area between the first end and the second end of the elastic member.

9. The refrigerator according to claim 8, wherein the stop protrusion and the engagement portion are configured to be positioned between the first rotation shaft and the second rotation shaft.

10. The refrigerator according to claim 4, wherein the stopper comprises:

a recessed portion that is recessed inward from a surface of the stopper facing the latch, that is configured to receive a part of the latch, and that is configured to avoid interference between the stopper and the latch;

a contact portion that protrudes from the upper end of the stopper toward an end of the pusher, that is located vertically above the recessed portion, and that is configured to contact the end of the pusher; and a stop protrusion that protrudes from an inner side of the recessed portion of the stopper and that is configured to, based on the latch receiving an end portion of the restraint device, engage with a portion of the latch and restrict movement of the latch from the stopper.

11. The refrigerator according to claim 10, wherein a vertical length of the recessed portion exceeds a vertical length of the latch, and wherein the latch is configured to rotate in a range between an upper end and a lower end of the recessed portion.

12. The refrigerator according to claim 10, wherein the first elastic member fixing portion is located vertically above the stop protrusion, and wherein the second elastic member fixing portion is located vertically above the recessed portion.

13. The refrigerator according to claim 10, wherein the latch is disposed between the contact portion of the stopper and the second rotation shaft.

14. The refrigerator according to claim 13, wherein the second elastic member fixing portion is located at a rear end of the stopper, and the contact portion is located at a front end of the stopper opposite to the rear end of the stopper.

15. The refrigerator according to claim 10, wherein the stopper has a planar shape, wherein the recessed portion is defined at a side of the stopper, wherein the contact portion is bent in a first direction from the upper end of the stopper, and wherein the second elastic member fixing portion is bent in a second direction from the upper end of the stopper opposite to the first direction.

16. The refrigerator according to claim 1, wherein the pusher includes:

a front end exposed to a front surface of the main-door and configured be pushed by the operation device; and a rear end configured to contact the stopper based on operation of the operation device.

17. The refrigerator according to claim 16, wherein the latch device further comprises a push guide that is located vertically above the latch and configured to guide movement of the pusher toward and from the stopper.

18. The refrigerator according to claim 1, wherein the sub-door is rotatably connected to the main-door and configured to rotate about a rotation shaft in a same direction as the main-door, and wherein the operation device is disposed at a side of the sub-door away from the rotation shaft of the sub-door.

19. The refrigerator according to claim 1, wherein the second rotation shaft is rotatably coupled to a lower end of the stopper located vertically below a lower end of the latch.

* * * * *